US009217952B2

(12) United States Patent
Koyama et al.

(10) Patent No.: US 9,217,952 B2
(45) Date of Patent: Dec. 22, 2015

(54) IMAGE FORMING UNIT AND IMAGE FORMING APPARATUS

(71) Applicant: Oki Data Corporation, Minato-ku, Tokyo (JP)

(72) Inventors: Tetsu Koyama, Tokyo (JP); Shun Hatanaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 164 days.

(21) Appl. No.: 13/777,453

(22) Filed: Feb. 26, 2013

(65) Prior Publication Data

US 2013/0223856 A1 Aug. 29, 2013

(30) Foreign Application Priority Data

Feb. 27, 2012 (JP) ..... 2012-039580

(51) Int. Cl.
*G03G 15/08* (2006.01)
*G03G 15/00* (2006.01)

(52) U.S. Cl.
CPC ..... *G03G 15/0824* (2013.01); *G03G 15/0849* (2013.01); *G03G 15/0862* (2013.01); *G03G 15/0877* (2013.01); *G03G 15/556* (2013.01); *G03G 15/0839* (2013.01)

(58) Field of Classification Search
CPC ..... G03G 15/0822; G03G 15/0831; G03G 15/0832; G03G 15/0839
USPC ..... 399/27, 258, 260
See application file for complete search history.

(56) References Cited

U.S. PATENT DOCUMENTS

2012/0294632 A1* 11/2012 Nishikawa ..... 399/27

FOREIGN PATENT DOCUMENTS

| | | | |
|---|---|---|---|
| JP | H07-152235 | A | 6/1995 |
| JP | 2005-164999 | A | 6/2005 |
| JP | 2006-072145 | A | 3/2006 |
| JP | 2007-101718 | A | 4/2007 |
| JP | 2011-221351 | A | 11/2011 |

OTHER PUBLICATIONS

Otani (JP 2007-101718), Apr. 2007, JPO Computer Translation.*
Suzuki (JP 2011-221351 A), Nov. 2011, JPO Computer Translation.*

* cited by examiner

*Primary Examiner* — Erika J Villaluna
(74) *Attorney, Agent, or Firm* — Panitch Schwarze Belisario & Nadel LLP

(57) ABSTRACT

An image forming unit includes an image bearing body, a developer bearing body that supplies a developer to the image bearing body, a developer storage portion for storing the developer, a developer reserving portion that reserves the developer, a replenishing member that replenishes the developer from the developer reserving portion to the developer storage portion, and a guide member provided between the replenishing member and the developer bearing body. The guide member temporarily holds the developer replenished by the replenishing member and regulates falling of the developer. A conveying member conveys the developer held by the guide member in an axial direction of the developer bearing body along the guide member. A detecting portion is provided between the guide member and the developer bearing body for detecting the developer. The replenishing member replenishes the developer to the developer storage portion based on a result of detection using the detecting portion.

25 Claims, 17 Drawing Sheets

IMAGE FORMING UNIT AND IMAGE FORMING APPARATUS

BACKGROUND OF THE INVENTION

The present invention relates to an image forming unit and an image forming apparatus.

An electrophotographic image forming apparatus generally includes an image forming unit. The image forming unit is configured as an integral unit including a photosensitive drum, a charging roller, a developing roller, a supplying roller and a cleaning roller. The image forming unit further includes a detachable toner reserving container.

A toner (developer) stored in the toner reserving container is supplied to a toner hopper in the image forming unit via a toner replenishing opening. The toner supplied to the toner hopper is agitated by an agitating member, and is supplied to the developing roller by the supplying roller. The toner supplied to the developing roller is used for developing a latent image formed on the photosensitive drum (see, for example, Japanese Laid-open Patent Publication No. 2007-101718).

However, in the general image forming apparatus, the toner starts to be supplied to the toner hopper immediately after the toner reserving container is mounted to a main body of the image forming unit. Therefore, the toner may remain in the toner hopper for a long time period while being agitated. This may cause deterioration of the toner.

SUMMARY OF THE INVENTION

An aspect of the present invention is intended to prevent deterioration of a developer.

According to an aspect of the present invention, there is provided an image forming unit including an image bearing body, a developer bearing body that supplies a developer to the image bearing body, a developer storage portion for storing the developer to be supplied to the developer bearing body, a developer reserving portion that reserves the developer to be supplied to the developer storage portion, a replenishing member that replenishes the developer from the developer reserving portion to the developer storage portion, a guide member provided between the replenishing member and the developer bearing body and configured to temporarily hold the developer replenished by the replenishing member and regulate falling of the developer, a conveying member that conveys the developer held by the guide member in an axial direction of the developer bearing body along the guide member, and a detecting portion provided between the guide member and the developer bearing body. The detecting portion is provided for detecting the developer. The replenishing member replenishes the developer to the developer storage portion based on a result of detection using the detecting portion.

Since the replenishing member replenishes the developer to the developer storage portion based on the result of detection using the detecting portion, the toner is prevented from remaining in the developer storage portion for a long time period. Therefore, deterioration of the developer can be prevented, and image quality can be enhanced.

According to another aspect of the present invention, there is provided an image forming apparatus including the image forming unit.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The drawings are provided for illustrative purpose and are not intended to limit the scope of the present invention.

First Embodiment

Figure 1:
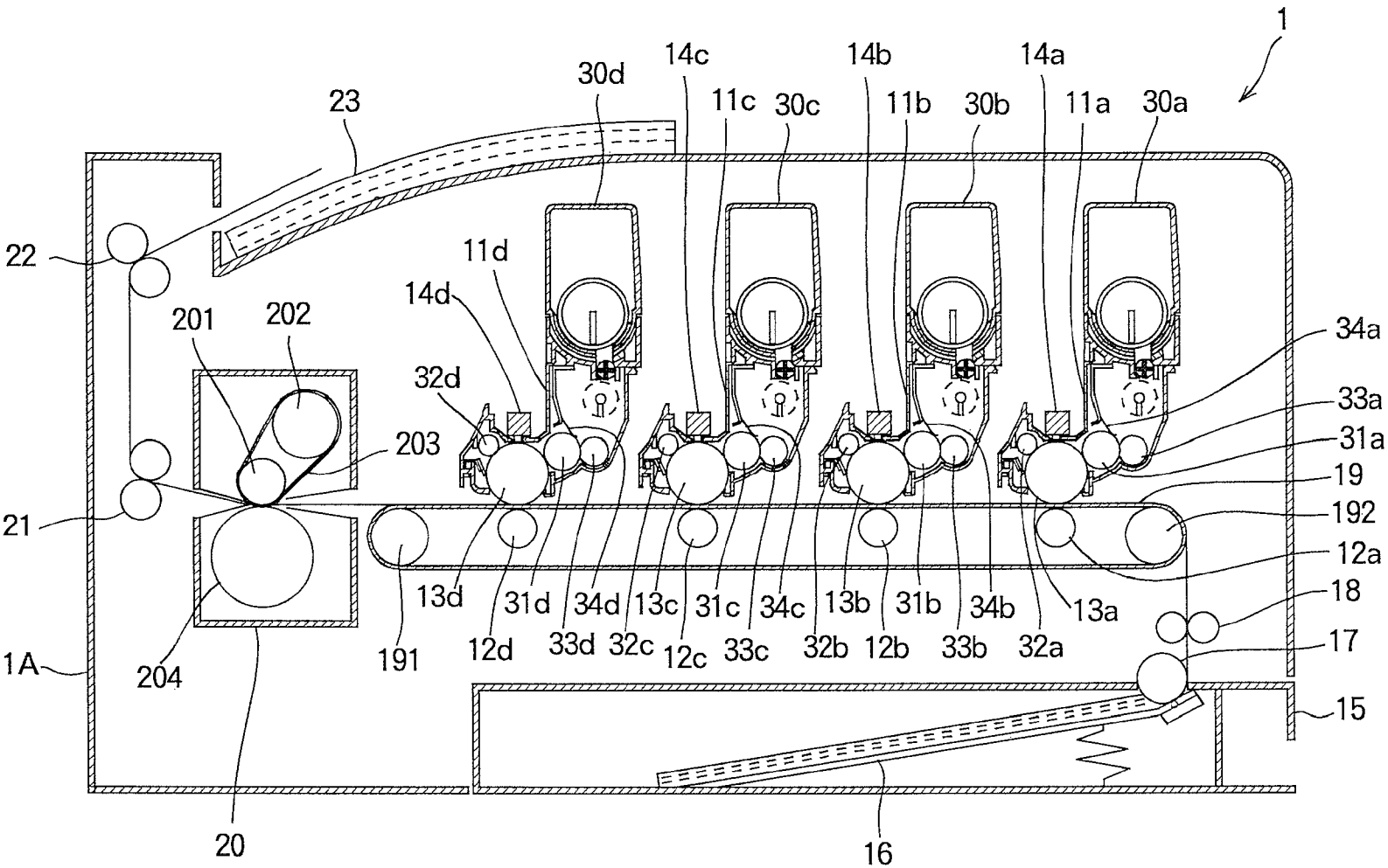
FIG. 1 is a sectional side view showing a basic configuration of an image forming apparatus according to the first embodiment of the present invention.

FIG. 1 is a sectional side view showing a basic configuration of an image forming apparatus according to the first embodiment of the present invention. The image forming apparatus 1 shown in FIG. 1 is configured as, for example, an electrophotographic color printer of a tandem type. The image forming apparatus 1 includes image forming units 11*a*, 11*b*, 11*c* and 11*d* that form images of black (K), cyan (C), magenta (M) and yellow (Y). The image forming units 11*a*, 11*b*, 11*c* and 11*d* are arranged in this order along a conveying path of a medium 16 (in this example, from the right to the left in FIG. 1).

The image forming units 11*a*, 11*b*, 11*c* and 11*d* respectively include photosensitive drums 13*a*, 13*b*, 13*c* and 13*d* as latent image bearing bodies (or image bearing bodies) that rotate clockwise in FIG. 1. Charging rollers 32*a*, 32*b*, 32*c* and 32*d* (i.e., charging members) and developing rollers 31*a*, 31*b*, 31*c* and 31*d* (i.e., developer bearing bodies) are respectively provided along outer circumferences of the photosensitive drums 13*a*, 13*b*, 13*c* and 13*d*. The charging rollers 32*a*, 32*b*, 32*c* and 32*d* are respectively configured to uniformly charge surfaces of the photosensitive drums 13*a*, 13*b*, 13*c* and 13*d*. The developing rollers 31*a*, 31*b*, 31*c* and 31*d* are respectively configured to develop latent images on the photosensitive drums 13*a*, 13*b*, 13*c* and 13*d* using toners.

Further, supplying rollers 33*a*, 33*b*, 33*c* and 33*d* (i.e., developer supplying members) and developing blades 34*a*, 34*b*, 34*c* and 34*d* (i.e., developer layer forming members) are respectively provided so as to contact surfaces of the developing rollers 31*a*, 31*b*, 31*c* and 31*d*. The supplying rollers 33*a*, 33*b*, 33*c* and 33*d* are respectively configured to supply the toners to the developing rollers 31*a*, 31*b*, 31*c* and 31*d*. The developing blades 34*a*, 34*b*, 34*c* and 34*d* are respectively configured to regulate thicknesses of toner layers (i.e., developer layers) on the surfaces of the developing rollers 31*a*, 31*b*, 31*c* and 31*d*.

The image forming units 11*a*, 11*b*, 11*c* and 11*d* respectively include toner reserving containers 30*a*, 30*b*, 30*c* and 30*d* (i.e., developer reserving portions) that respectively reserve black, cyan, magenta and yellow toners (i.e., developers).

Exposure heads 14*a*, 14*b*, 14*c* and 14*d* are respectively provided above the photosensitive drums 13*a*, 13*b*, 13*c* and 13*d*. The exposure heads 14*a*, 14*b*, 14*c* and 14*d* face the photosensitive drums 13*a*, 13*b*, 13*c* and 13*d* with constant gaps. The exposure heads 14*a*, 14*b*, 14*c* and 14*d* are configured as, for example, LED (Light Emitting Diode) arrays.

A medium tray 15 is detachably mounted to a lower part of the image forming apparatus 1. The medium tray 15 stores media 16 such as printing sheets. A feeding roller 17 (i.e., a feeding mechanism) is provided above the medium tray 15. The feeding roller 17 is configured to separate the media 18 in the medium tray 15, and feed each medium 18 into a conveying path. A pair of conveying rollers 18 (i.e., a conveying mechanism) are provided along the conveying path of the medium 16 fed by the feeding roller 17. The conveying rollers 18 are configured to convey the medium 16 toward the image forming units 11*a*, 11*b*, 11*c* and 11*d*.

A transfer belt 19 is provided below the image forming units 11*a*, 11*b*, 11*c* and 11*d*. The transfer belt 19 is provided for transferring the toner images from the photosensitive drums 13*a*, 13*b*, 13*c* and 13*d* to the medium 16. Transfer rollers 12*a*, 12*b*, 12*c* and 12*d* (i.e., transfer members) are provided so as to face the photosensitive drums 13*a*, 13*b*, 13*c* and 13*d* via the transfer belt 19.

The transfer belt 19 is stretched around a driving roller 191 and a tensioning roller 192. The transfer belt 19 rotates by a rotation of the driving roller 191. The transfer belt 19 holds the medium 16 (conveyed by the conveying rollers 18) using electrostatic force, and conveys the medium 16 along the image forming units 11*a*, 11*b*, 11*c* and 11*d*.

A fixing unit 20 is provided on a downstream side of the image forming units 11*a*, 11*b*, 11*c* and 11*d* along the conveying path of the medium 16. The fixing unit 20 is provided for fixing the toner image to the medium 16.

The fixing unit 20 includes, for example, a fixing roller 201, a stretching roller 202, a fixing belt 203, and a pressing roller 204. The fixing roller 201 has an internal heater as a heat source. The stretching roller 202 is provided so as to face the fixing roller 201. The fixing belt 203 is stretched around the fixing roller 201 and the stretching roller 202. The pressing roller 204 is pressed against the fixing roller 201 via the fixing belt 203. The fixing unit 20 is configured to heat and press the medium 16 at a nip portion between the fixing roller 201 and the pressing roller 204 to fix the toner image to the medium 16.

In this regard, the fixing unit 20 is not limited to the above described type. The fixing unit 20 can be of a type that heats and presses the medium 16 at a nip portion between the fixing roller and the pressing roller without using the fixing belt.

Two pairs of ejection rollers 21 and 22 (i.e., an ejection mechanism) are provided on a downstream side of the fixing unit 20. The ejection rollers 21 and 22 are configured to eject the medium 16 (to which the toner image is fixed) to a stacker portion 23.

The image forming units 11*a*, 11*b*, 11*c* and 11*d* and the medium tray 15 are detachably mounted to a main body of the image forming apparatus 1. A part of the image forming apparatus 1 except the image forming units 11*a*, 11*b*, 11*c* and 11*d* and the medium tray 15 is referred to as a main body 1A of the image forming apparatus 1. The main body 1A of the image forming apparatus 1 is also referred to as an apparatus main body 1A.

The image forming units 11*a*, 11*b*, 11*c* and 11*d* will be herein described. The image forming units 11*a*, 11*b*, 11*c* and 11*d* have the same configuration except the toners. Therefore, the image forming units 11*a*, 11*b*, 11*c* and 11*d* are referred to as the image forming units 11. Components (for example, the developing rollers 31*a*, 31*b*, 31*c* and 31*d*) of the image forming units 11 are referred to with symbols "a", "b", "c" and "d" omitted.

Figure 2:
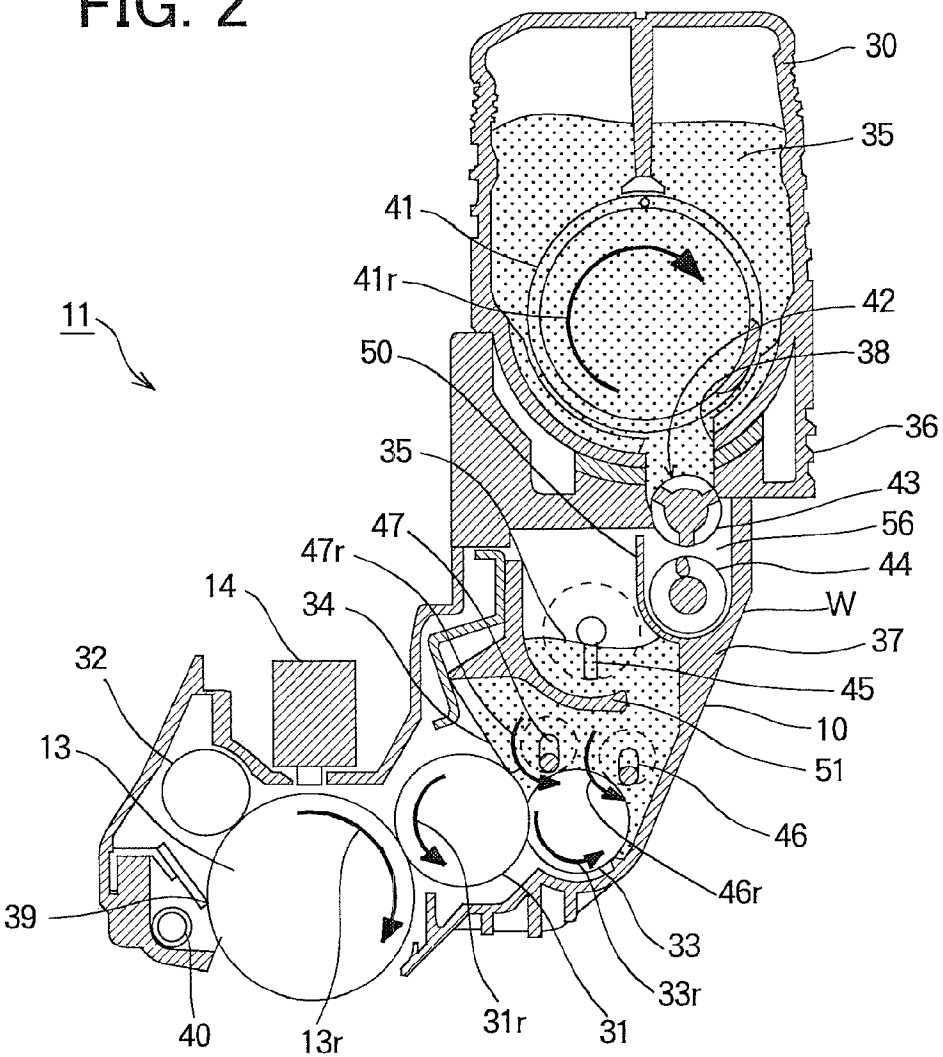
FIG. 2 is a sectional side view showing a configuration of an image forming unit according to the first embodiment of the present invention.

FIG. 2 is a sectional side view showing a configuration of the image forming unit 11. As shown in FIG. 2, the image forming unit 11 includes a detachable toner reserving container 30 as a developer reserving portion. A part of the image forming unit 11 except the toner reserving container 30 is referred to as an image forming unit main body 10.

The toner reserving container 30 is a container in which a toner 35 (i.e., a developer) is stored. The toner reserving container 30 includes an agitating member 41 therein. The agitating member 41 is configured to agitate the toner 35. The agitating member 41 is in the form of, for example, a crank bar. The agitating member 41 rotates in a direction shown by an arrow 41*r* (clockwise) to agitate the toner 35 in the toner reserving container 30.

The toner reserving container 30 includes a toner supplying opening 38 and a shutter (not shown) for opening and closing the toner supplying opening 38. When the toner reserving container 30 is mounted to the image forming unit main body 10, the shutter opens the toner supply opening 38 to allow the toner 35 to be supplied to the image forming unit main body 10.

The image forming unit main body 10 of the image forming unit 11 includes a toner hopper 37 (i.e., a developer storage portion) for storing the toner 35 replenished by the toner reserving container 30. An upper part of the toner hopper 37 is covered with a cover 36. The cover 36 has a replenishing opening 42 through which the toner 35 is replenished from the toner reserving container 30 to the toner hopper 37. The replenishing opening 42 is provided so as to face the toner supplying opening 38 of the toner reserving container 30.

The photosensitive drum 13, the developing roller 31 and the supplying roller 33 have rotation axes which are mutually parallel. The image forming unit 11 has an elongated shape in a direction of the rotation axes of the photosensitive drum 13, the developing roller 31 and the supplying roller 33. Also, the toner hopper 37 has an elongated shape in the direction of the rotation axes of the photosensitive drum 13, the developing roller 31 and the supplying roller 33.

Figure 3:
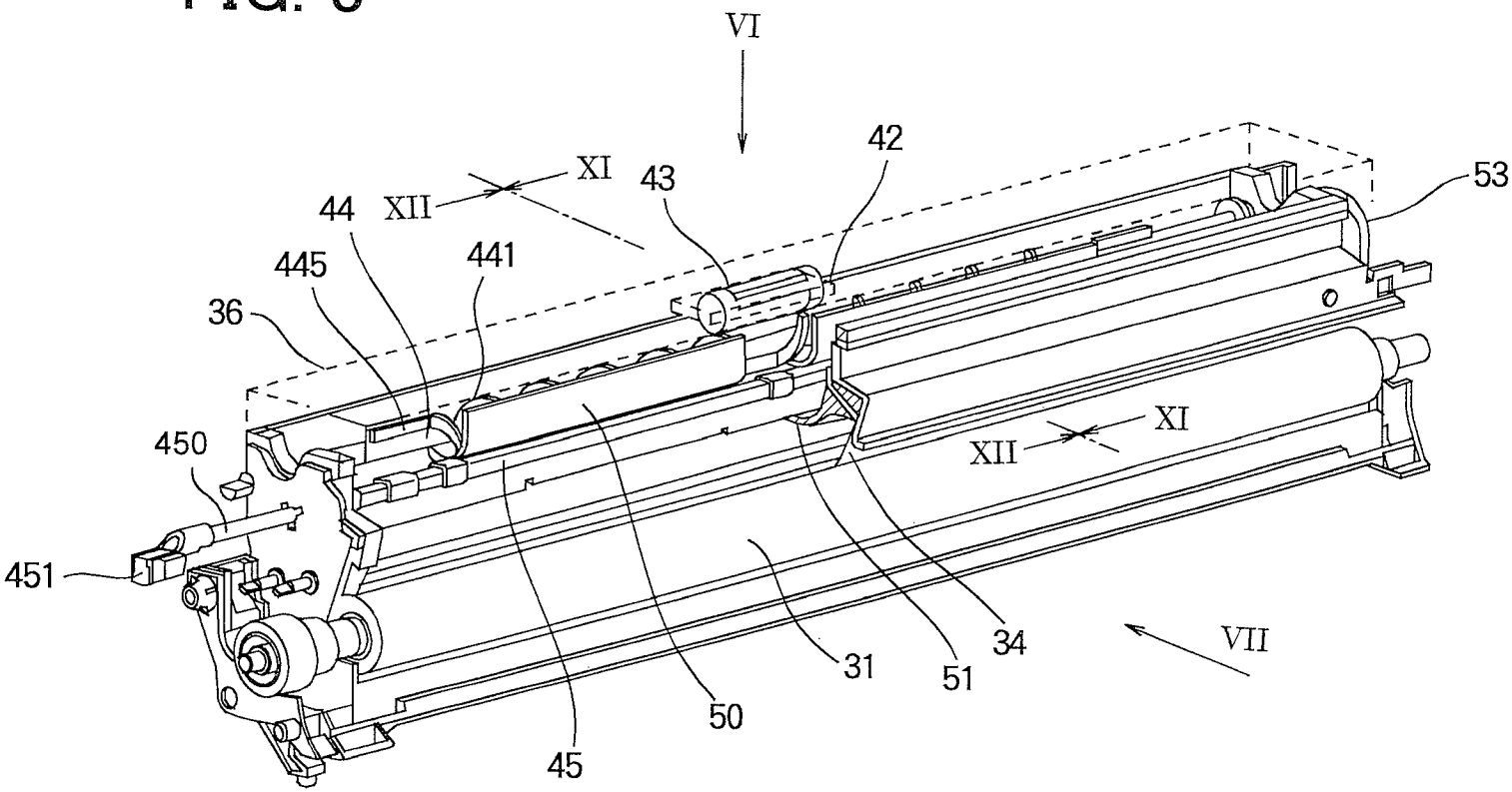
FIG. 3 is a perspective view showing a configuration of a main body of the image forming unit according to the first embodiment of the present invention.

FIG. 3 is a partially cutaway perspective view showing a configuration of the image forming unit main body 10. The above described replenishing opening 42 is formed on a center portion of the image forming unit 11 in a longitudinal direction of the image forming unit 11. A replenishing member 43 is provided inside the replenishing opening 42. The replenishing member 43 rotates to cause the toner 35 to fall into the toner hopper 37.

Figure 4:
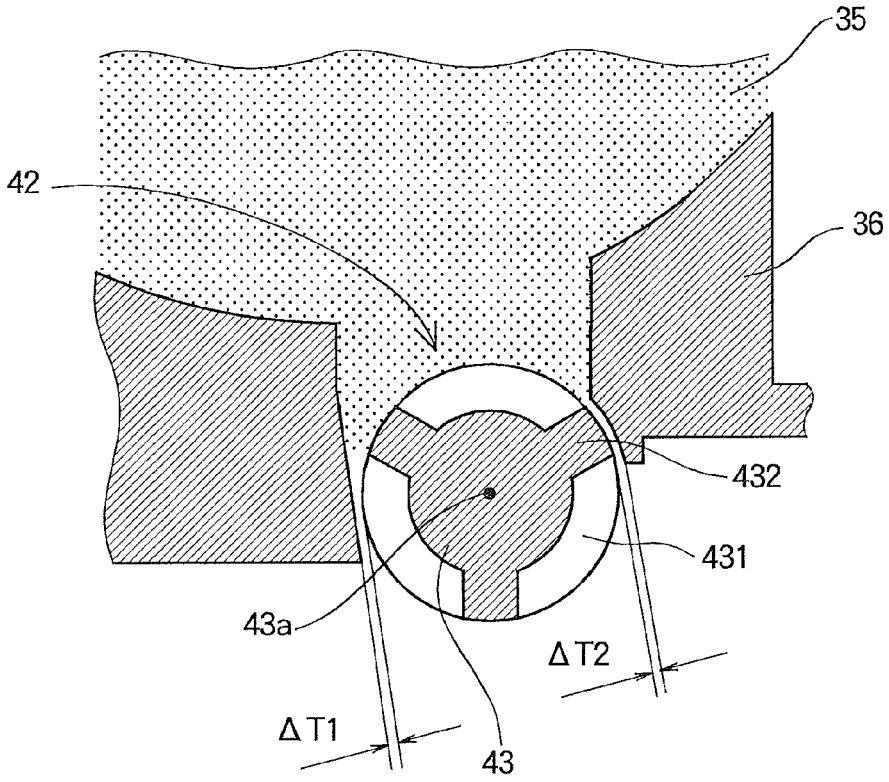
FIG. 4 is a sectional view showing a replenishing member and an replenishing opening according to the first embodiment of the present invention.

FIG. 4 is a sectional view showing the replenishing member 43 and the replenishing opening 42. The replenishing member 43 has a substantially cylindrical shape whose axial direction is parallel to the direction of the rotation axis (i.e., an axial direction) of the developing roller 31. The replenishing member 43 is rotatable about a rotation axis 43*a*. A plurality of (in this example, three) concave portions 431 are formed on an outer circumference of the replenishing member 43. The concave portions 431 are arranged in a circumferential direction of the replenishing member 43. Blade portions 432 are formed between mutually adjacent concave portions 431.

The outer circumference of the replenishing member 43 faces the replenishing opening 42 with a gap ΔT1 on one side (i.e., the left side in FIG. 4) and a gap ΔT2 on the other side (i.e., the right side in FIG. 4). Each of the gaps ΔT1 and ΔT2 is minute, and is smaller than, for example, 1 mm. Therefore, when the replenishing member 43 does not rotate, the toner 35 stored in the toner reserving container 30 does not pass the replenishing opening 42. In contrast, when the replenishing member 43 rotates, the toner 35 stored in the toner reserving container 30 passes the replenishing opening 42 by actions of the blade portions 432 (the concave portions 431), and falls into the toner hopper 37.

Referring back to FIG. 2, a conveying member 44 is provided in the toner hopper 37. The conveying member 44 is located below the replenishing member 43. The conveying member 44 is configured to convey the toner 35 in a longitudinal direction of the toner hopper 37 (i.e., the axial direction of the developing roller 31).

In this specification, the term "below" is not only limited to "vertically below", but also includes "obliquely below". For example, when it is described that the conveying member 44 is provided below the replenishing member 43, it means that the conveying member 44 and the replenishing member 43 are in a positional relationship in which the toner 35 falls from the replenishing member 43 can reach the conveying member 44. Similarly, the term "above" is not only limited to "vertically above", but also includes "obliquely above".

Figure 5:
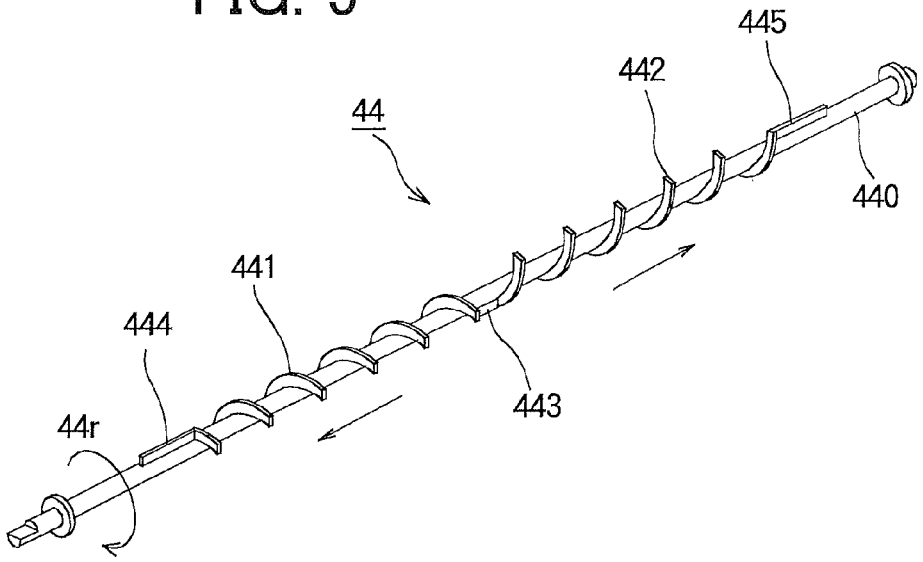
FIG. 5 is a perspective view showing a configuration of the agitating member according to the first embodiment of the present invention.

FIG. 5 is a perspective view showing a configuration of the conveying member 44. The conveying member 44 includes a shaft 440 and spiral portions 441 and 442 formed around the shaft 440. The spiral portions 441 and 442 are formed on both sides of the shaft 440 with respect to a center portion of the shaft 440 in the axial direction. The spiral portions 441 and 442 have opposite winding directions. The conveying member 44 is rotated by a motor 62 (FIG. 10) described later. When the conveying member 44 rotates, the spiral portions 441 and 442 convey the toner 35 in an axial direction. The spiral portions 441 and 442 have winding directions so that the spiral portions 441 and 442 convey the toner 35 from the center portion of the conveying member 44 to both end portions of the conveying member 44 in the axial direction.

A protruding portion 443 is formed between the spiral portions 441 and 442 of the conveying member 44. The protruding portion 443 extends in a direction parallel to the shaft 440. Additionally, protruding portions 444 and 445 are formed on both sides of the spiral portions 441 and 442 of the conveying member 44 in the axial direction. The protruding portions 444 and 445 extend in the direction parallel to the shaft 440. The protruding portions 443, 444 and 445 have a function to push the toner 35 in a rotating direction (i.e., a circumferential direction) of the conveying member 44.

Referring back to FIG. 2, a guide member 50 is provided along an outer circumference of the conveying member 44. The guide member 50 is configured to guide the toner 35 (conveyed by the conveying member 44) in the longitudinal direction of the toner hopper 37 (i.e., the axial direction of the developing roller 31). The guide member 50 is connected to a wall portion W of the toner hopper 37 at a position where the guide member 50 faces a bottom portion of the conveying member 44. The guide member 50 extends in an arc shape to a position where the guide member 50 faces a side portion of the conveying member 44.

An opening 56 is formed between the guide member 50 and the wall portion W of the toner hopper 37. The opening 56 faces the replenishing opening 42. The toner 35 replenished from the replenishing opening 42 by the replenishing member 43 falls into a region inside the guide member 50 (i.e., a region between the guide member 50 and the wall portion W). A conveying region is formed inside the guide member 50 where the toner 35 (replenished from the replenishing opening 42) is conveyed by the conveying member 44.

Figure 6:
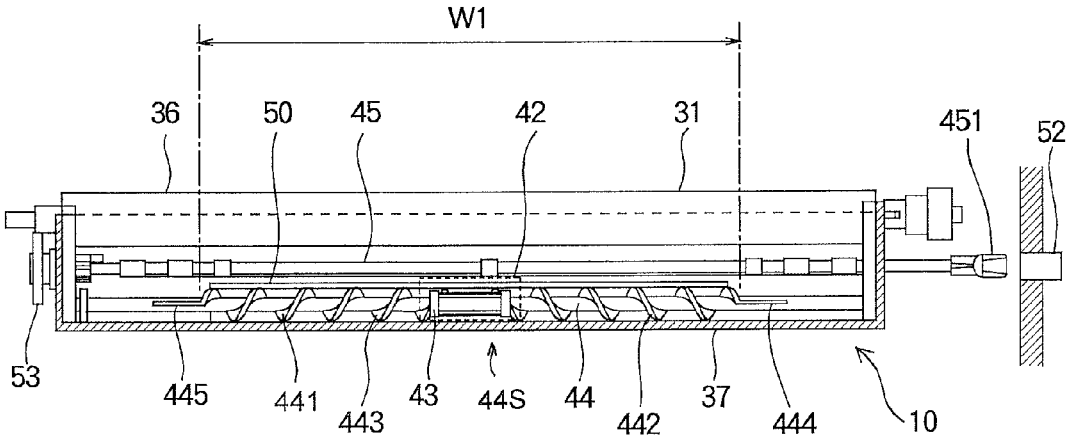
FIG. 6 is a sectional view showing the main body of the image forming unit as seen in a direction shown by an arrow VI in FIG. 3.
Figure 7:
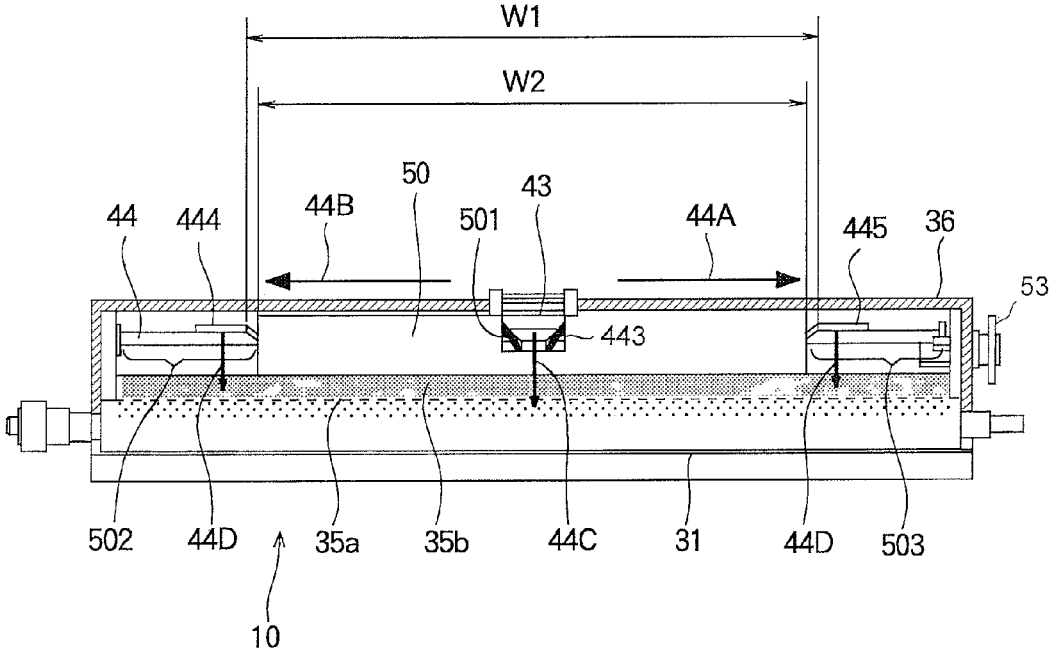
FIG. 7 is a sectional view showing the main body of the image forming unit as seen in a direction shown by an arrow VII in FIG. 3.

FIG. 6 is a sectional view of the image forming unit main body 10 as seen in a direction shown by an arrow VI in FIG. 3. FIG. 7 is a sectional view of the image forming unit main body 10 as seen in a direction shown by an arrow VII in FIG. 3. As shown in FIG. 6, the guide member 50 extends in a direction parallel to the conveying member 44. In other words, the guide member 50 extends in a direction parallel to the longitudinal direction of the image forming unit 11 (i.e., the axial direction of the developing roller 31).

As shown in FIG. 7, an ejection opening 501 is formed on a center portion of the guide member 50 in the longitudinal direction of the guide member 50. Further, ejection openings 502 and 503 are formed on both ends of the guide member 50 in the longitudinal direction of the guide member 50. The ejection openings 501, 502 and 503 respectively correspond to the protruding portions 443, 444 and 445 (FIG. 5) of the conveying member 44. The toner 35 pushed by the protruding portions 443, 444 and 445 of the conveying member 44 in the rotating direction passes the ejection openings 501, 502 and 503, and moves toward a remaining amount detecting member 45 described later.

In FIG. 7, a length W2 of the guide member 50 (i.e., a dimension of the guide member 50 in the longitudinal direction except the ejection openings 502 and 503 on both ends) is shorter than a length W1 of a region (i.e., a spiral forming region 44S shown in FIG. 6) of the conveying member 44 where the spiral portions 441 and 442 are formed. Both ends of the spiral forming region 44S in the longitudinal direction protrude from both ends of the guide member 50. The ejection opening 501 is located on a substantially center portion of the guide member 50 in the longitudinal direction. More specifically, the ejection opening 501 is located within a distance of ±W2×20% from the center portion of the guide member 50 in the longitudinal direction.

Figure 8:
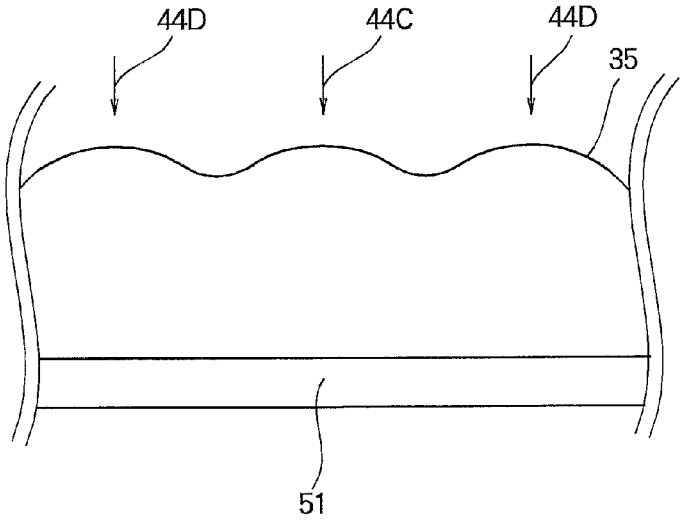
FIG. 8 is a schematic view showing a manner in which a toner is accumulated on a regulating member according to the first embodiment of the present invention.

With such a configuration, as schematically shown in FIG. 8, the toner 35 is uniformly accumulated on a regulating member 51 (described later) as shown by arrows 44C and 44D.

Referring back to FIG. 2, a remaining amount detecting member 45 (i.e., a detecting portion) is provided in the toner hopper 37. The remaining amount detecting member 45 is located at a position lower than the conveying member 44 and on a side (i.e., the left side in FIG. 2) of the conveying member 44. The remaining amount detecting member 45 is provided for detecting a remaining amount of the toner 35 in the toner hopper 37.

Figure 9:
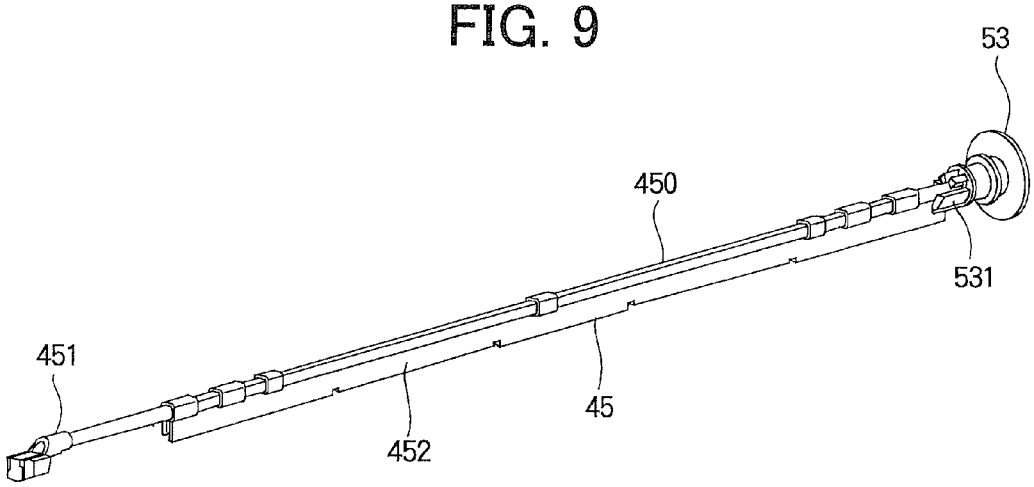
FIG. 9 is a perspective view showing a configuration of a remaining amount detecting member according to the first embodiment of the present invention.

FIG. 9 is a perspective view showing a configuration of the remaining amount detecting member 45. The remaining amount detecting member 45 includes a shaft 450 extending in the longitudinal direction of the toner hopper 37 (i.e., the axial direction of the developing roller 31) and a blade portion 452 provided on the shaft 450. The blade portion 452 has a plate shape, and extends in the longitudinal direction of the shaft 450.

A rotation member 53 is provided in the vicinity of an end portion of the shaft 450 of the remaining amount detecting member 45. The rotation member 53 is provided for causing the remaining amount detecting member 45 to rotate. The rotation member 53 is rotated by a motor 62 (FIG. 9) described later. The rotation member 53 has a protruding portion 531 that contacts an end portion of the blade portion 452 and pushes the blade portion 452 in the rotating direction. When the rotation member 53 rotates, the protruding portion 531 pushes the blade portion 452 in the rotating direction and causes the remaining amount detecting member 45 to rotate.

The other end of the shaft 450 of the remaining amount detecting member 45 protrudes outside the toner hopper 37 through the wall portion of the toner hopper 37 (see FIG. 3). A reflection plate 451 (i.e., a detection target body) is provided on the end of the shaft 450 protruding outside the toner hopper 37. The reflection plate 451 is provided at a position shifted from a rotation axis of the shaft 450 toward the same side as the blade portion 452.

A gravity center of a whole body of the remaining amount detecting member 45 including the shaft 450, the blade portion 452 and the reflection plate 451 is shifted toward a tip of the blade portion 452 with respect to the rotation axis of the shaft 450. Therefore, when no force is applied to the remaining amount detecting member 45, the remaining amount detecting member 45 is in a rotational position where the blade portion 452 is directed downward due to gravity. In this state, the reflection plate 451 is in a bottom dead point.

A remaining amount detecting sensor 52 (FIG. 6) is fixed to a wall portion of the image forming unit 10 so as to face the reflection plate 451 of the remaining amount detecting member 45. The remaining amount detecting sensor 52 is configured as a reflection-type sensor. More specifically, the remaining amount detecting sensor 52 includes a light emitting element that emits light, and a light receiving element that receives reflection light. When the reflection plate 451 is in a predetermined position (i.e., the bottom dead point), the remaining amount detecting sensor 452 receives the reflection light from the reflection plate 451, and detects a rotational position of the remaining amount detecting member 45.

Referring back to FIG. 2, the regulating member 51 is 10 provided below the remaining amount detecting member 45. The regulating member 51 is in the form of a protrusion, and extends along an outer circumference of the remaining amount detecting member 45. The regulating member 51 extends in an arc shape having a central angle greater than 90 degrees. That is, the 15 regulating member 51 extends from a bottom portion to a side portion of the remaining amount detecting member 45. Further, a certain gap is formed between the regulating member 51 and the outer circumference of the remaining amount detecting member 45. The toner 35 is accumulated and is temporarily held on the 20 regulating member 51.

A detection region is formed on the regulating member 51. In the detection region, the toner 35 is agitated by the remaining amount detecting member 45, and the remaining amount of the toner 35 is measured using a method described later. As was described with reference to FIG. 8, the toner 35 ejected from the ejection openings 501, 502 and 503 of the guide member 50 is accumulated on the regulating member 51 and is uniformly distributed. A gap portion 51*a* (FIG. 11B) is formed between the regulating member 51 and the wall portion W of the toner hopper 37. The gap portion 51*a* functions as an opening through which the toner 35 is supplied to a region below the regulating member (i.e., a region where the supplying roller 33 is provided). In this regard, the developing roller 31 is not located directly below the gap portion 51*a*.

Agitating members 46 and 47 are provided in the toner hopper 37. The agitating members 46 and 47 are located above and in the vicinity of the supplying roller 33. The agitating members 46 and 47 are in the form of crank bars which are parallel to each other. The agitating members 46 and 47 are driven to rotate in the same direction shown by arrows 46*r* and 47*r* to agitate the toner 35. The agitating members 46 and 47 have a function to reduce agglomeration of the toner 35 so that the toner 35 is smoothly supplied to the supplying roller 33.

The agitating members 46 and 47 are separated (partitioned) from the remaining amount detecting member 45 by the regulating member 51. Therefore, the toner 35 in the detection region (i.e., on the regulating member 51) is prevented from being influenced by rotations of the agitating members 46 and 47. Therefore, the toner 35 on the regulating member 51 is agitated only by the rotation of the remaining amount detecting member 45.

Referring back to FIG. 2, a cleaning blade 39 is provided so as to contact the surface of the photosensitive drum 13. The cleaning blade 39 is made of a resilient body. The cleaning blade 39 is configured to scrapes off a waste toner adhering to the surface of the photosensitive drum 13. A waste toner conveying member 40 is provided below the cleaning blade 39. The waste toner conveying member 40 is configured to collect the waste toner scraped off by the cleaning blade 39 and eject the waste toner outside the image forming unit 11.

Figure 10:
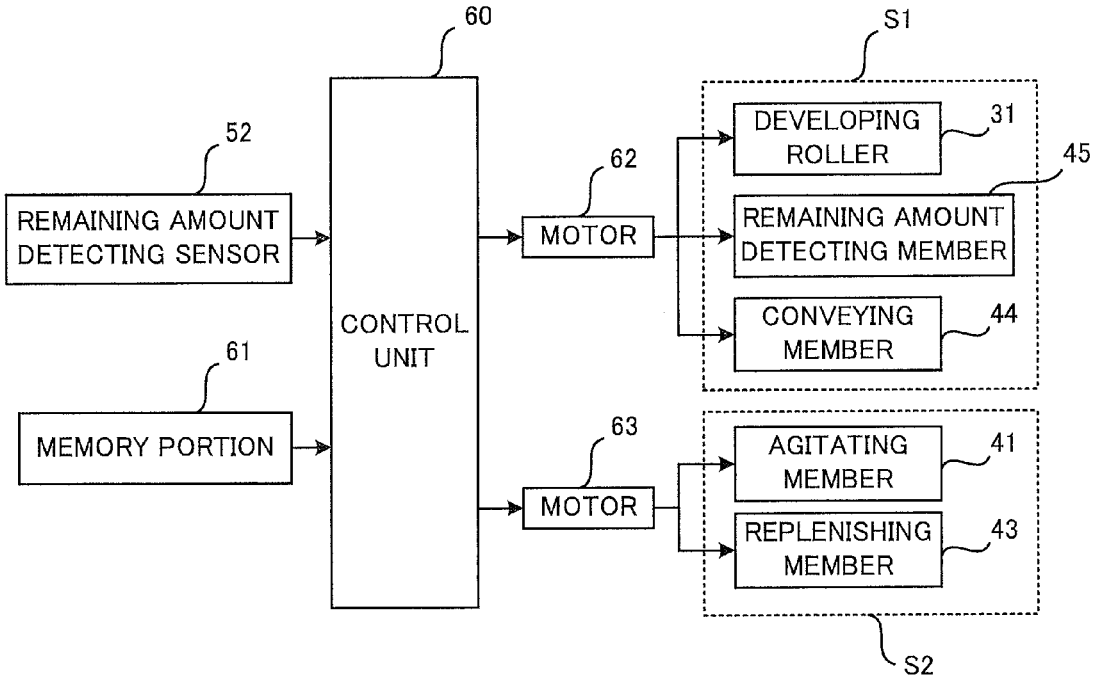
FIG. 10 is a block diagram of a control system for controlling a toner replenishing operation according to the first embodiment of the present invention.

FIG. 10 is a block diagram showing a control system for controlling a toner replenishing operation of each image forming unit 11. A control unit 60 controls a motor 62 for rotating the developing roller 31, the remaining amount detecting member 45 and the conveying member 44 of the image forming unit 11. The control unit 60 also controls a motor 63 for rotating the agitating member 41 and the replenishing member 43 of the image forming unit 11.

The control unit 60 is connected to the remaining amount detecting sensor 52. A detection signal from the remaining amount detecting sensor 52 is inputted to the control unit 60. The control unit 60 is connected to a memory portion 61 that stores time information (i.e., threshold) described later. The control unit 60 determines whether the remaining amount of the toner 35 in the toner hopper 37 is smaller than a reference value or not based on the detection signal from the remaining amount detecting sensor 52 with reference to the time information stored in the memory portion 61.

Next, an entire operation of the image forming apparatus 1 will be described with reference to FIGS. 1 and 2. The image forming apparatus 1 starts an image forming operation (i.e., a printing operation) upon receipt of print command from a host device such as a personal computer. First, the feeding roller 17 rotates to feed the medium 16 out of the medium tray 15 into the conveying path. The conveying rollers 18 rotate to convey the medium 16 to the transfer belt 19. The transfer belt 19 holds the medium 16 using electrostatic force, and conveys the medium 16 along the image forming unit 11*a*, 11*b*, 11*c* and 11*d*.

The control unit 60 starts rotation of the motor 62 (FIG. 10) of each image forming unit 11 (FIG. 2) at the same time as starting of the image forming operation. As the motor 62 starts rotating, the developing roller 31 rotates in a direction shown by an arrow 31*r* in FIG. 2. The rotation of the developing roller 31 is transmitted to the photosensitive drum 13 and the supplying roller 33. The photosensitive drum 13 and the supplying roller 33 rotate in directions respectively shown by arrows 13*r* and 33*r*.

At the same time, the rotation of the developing roller 31 is also transmitted to the agitating members 46 and 47. The agitating members 46 and 47 rotate in directions shown by the arrows 46*r* and 47*r*, and agitate the toner 35 around the supplying roller 33.

The toner 35 agitated by the agitating members 46 and 47 is supplied to the developing roller 31 by the supplying roller 33. The toner supplied to the developing roller 31 forms a toner thin layer (i.e., a developer layer). The thickness of the toner thin layer is regulated by the developing blade 34. In this process, the toner is charged by friction.

As the photosensitive drum 13 rotates in the direction shown by the arrow 13*r*, the surface of the photosensitive drum 13 is uniformly charged by the charging roller 32, and then irradiated with light emitted by the exposure head 14 based on the image data. An electric potential of an exposed part of the surface of the photosensitive drum 13 decreases to 0V. In contrast, an electric potential of a non-exposed part of the surface of the photosensitive drum 13 does not decrease. Therefore, a latent image is formed on the surface of the photosensitive drum 13. The toner on the surface of the developing roller 31 adheres to the latent image on the surface of the photosensitive drum 13. In other words, the latent image is developed with the toner, and a toner image is formed.

The toner image on the surface of the photosensitive drum 13 is transferred to the medium 16 by the transfer belt 19 and the transfer roller 12. After the transferring of the toner image, a residual toner remaining on the surface of the photosensitive drum 13 is scraped off by the cleaning blade 39. The waste toner is collected by the waste toner conveying member 40, and is conveyed outside the image forming unit 11.

The medium 16 to which the toner image is transferred is conveyed to the fixing unit 20. The fixing unit 20 fixes the toner image to the medium 16 by application of heat and pressure. The medium 16 is then ejected by the ejection rollers 21 and 22 to the stacker portion 23. With this, an image forming operation is completed.

Figure 11A:
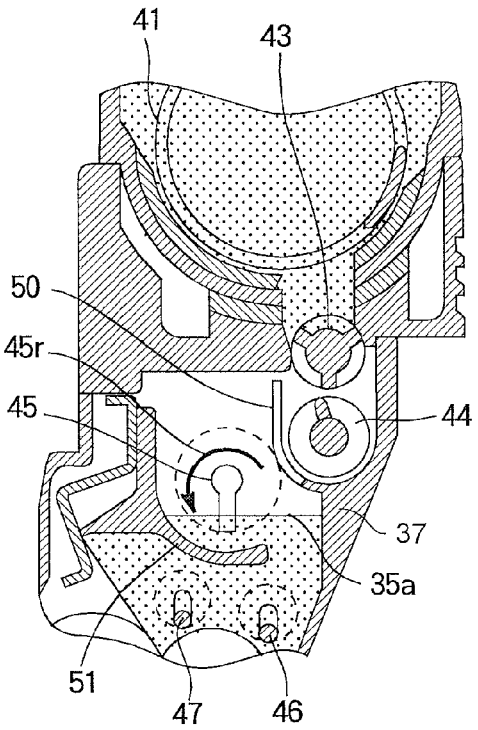
FIG. 11A is a schematic sectional view showing functions of the replenishing member, a conveying member and the remaining amount detecting member when a remaining amount of the toner in a toner hopper is small.
Figure 11B:
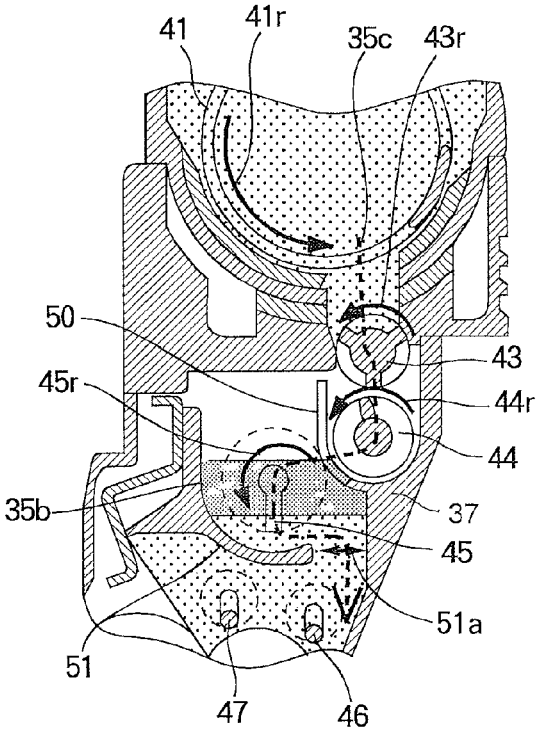
FIG. 11B is a schematic sectional view showing functions of the replenishing member, the conveying member and the remaining amount detecting member when the remaining amount of the toner in the toner hopper is large.

FIG. 11A is a schematic sectional view showing functions of the replenishing member 43, the conveying member 44 and the remaining amount detecting member 45 when the remaining amount of the toner 35 in the toner hopper 37 is small. FIG. 11B is a schematic sectional view showing functions of the replenishing member 43, the conveying member 44 and the remaining amount detecting member 45 when the remaining amount of the toner 35 in the toner hopper 37 is large. FIGS. 11A and 11B correspond to a sectional view as seen in a direction shown by an arrow XI in FIG. 3.

Figure 12A:
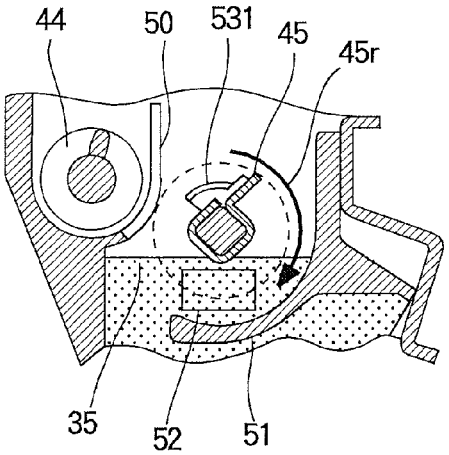
FIG. 12A is a schematic sectional view showing functions of the conveying member and the remaining amount detecting member when the remaining amount of the toner in the toner hopper is small.
Figure 12B:
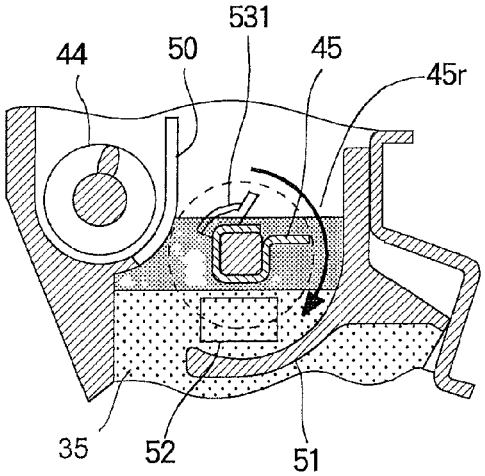
FIG. 12B is a schematic sectional view showing functions of the conveying member and the remaining amount detecting member when the remaining amount of the toner in the toner hopper is large.

FIG. 12A is a schematic sectional view showing functions of the conveying member 44 and the remaining amount detecting member 45 when the remaining amount of the toner 35 in the toner hopper 37 is small. FIG. 12B is a schematic sectional view showing functions of the conveying member 44 and the remaining amount detecting member 45 when the remaining amount of the toner 35 in the toner hopper 37 is large. FIGS. 12A and 12B correspond to a sectional view as seen in a direction shown by an arrow XII in FIG. 3.

When the image forming unit 11 is performing an image forming operation, the remaining amount detecting member 45 rotates in a direction shown by an arrow 45*r* by being pushed by the protruding portion 531 (FIG. 12A) of the rotation member 53 rotated by the motor 62 at a constant speed.

When the remaining amount of the toner 35 is small, the remaining amount detecting member 45 passes a top dead point (i.e., an uppermost position of a rotational area), then rotates downward (i.e., falls) by gravity separately from the protruding portion 531 of the rotation member 53, and reaches the bottom dead point. In other words, the remaining amount detecting member 45 reaches the bottom dead point before the protruding portion 531 of the rotation member 53 reaches the bottom dead point. The remaining amount detecting sensor 52 is located at a position corresponding to the bottom dead point of the reflection plate 451 of the remaining amount detecting member 45. The control unit 60 measures a staying time of the remaining amount detecting member 45 at the bottom dead point based on the detection signal of the remaining amount detecting sensor 52.

The memory portion 61 stores a setting time Ts (i.e., threshold) which is previously determined. The control unit 60 compares the staying time of the remaining amount detecting member 45 at the bottom dead point (measured based on the detection signal of the remaining amount detecting sensor 52) with the setting time Ts. If the staying time of the remaining amount detecting member 45 at the bottom dead point is longer than the setting time Ts, the control unit 60 determines that the remaining amount of the toner 35 is smaller than a reference amount.

In this case, the control unit 60 drives the motor 63 to cause the agitating member 41 and the replenishing member 43 to rotate.

As shown in FIG. 11B, the agitating member 41 in the toner reserving container 30 rotates in a direction shown by the arrow 41*r*, and agitates the toner 35. At the same time, the replenishing member 43 in the replenishing opening 42 rotates in a direction shown by an arrow 43*r*, and causes the toner 35 to fall into the toner hopper 37 via the replenishing opening 42.

The toner 35 replenished to the toner hopper 37 falls into the conveying region inside the guide member 50. In the conveying region, the conveying member 44 rotates in a direction shown by an arrow 44*r*. The spiral portions 441 and 442 convey the toner 35 toward both ends of the conveying member 44 as shown by arrows 44A and 44B in FIG. 7.

As shown in FIG. 7, the toner 35 existing in the center portion of the conveying member 44 is pushed by the protruding portion 443 of the conveying member 44 in the rotating direction. Then, the toner 35 is fed through the ejection opening 501 of the guide member 50 in a direction shown by an arrow 44C toward the remaining amount detecting member 45. In this regard, the protruding portion 443 is located at the center portion of the conveying member 44, and the ejection opening 501 is located at the center portion of the guide member 50 as described above.

The toner 35 reaching both ends of the conveying member 44 is pushed by the protruding portions 444 and 445 of the conveying member 44 in the rotating direction. Then, the toner 35 is fed through the ejection openings 502 and 503 of the guide member 50 in a direction shown by arrows 44D toward the remaining amount detecting member 45. In this regard, the protruding portions 444 and 445 are located at both end portions of the conveying member 44, and the ejection openings 502 and 503 are located at both end portions of the guide member 50 as described above.

The toner 35 fed out through the ejection openings 501, 502 and 503 of the guide member 50 is accumulated on the regulating member 51 as shown by a mark 35*b* in FIG. 11B. The toner 35 on the regulating member 51 is agitated by the remaining amount detecting member 45, so that the toner 35 is uniformly distributed in the longitudinal direction of the remaining amount detecting member 45 (i.e., the longitudinal direction of the toner hopper 37). A flow of the toner 35 is shown by an arrow 35C in FIG. 11B.

While the remaining amount detecting member 45 is rotating, the control unit 60 continuously measures the staying time of the remaining amount detecting member 45 at the bottom dead point based on the detection signal of the remaining amount detecting sensor 52, and compares the staying time with the setting time Ts.

When the remaining amount of the toner 35 increases as shown in FIG. 12B, a resistance to the remaining amount detecting member 45 by the toner 35 accumulated on the regulating member 51 also increases. When the remaining amount of the toner 35 exceeds a predetermined amount (i.e., a reference amount), the remaining amount detecting member 45 does not fall, but rotates at a constant speed by being pushed by the protruding portion 531 of the rotation member 53. Therefore, the remaining amount detecting member 45 reaches the bottom dead point at the same as the protruding portion 531 reaches the bottom dead point. Accordingly, the staying time of the remaining amount detecting member 45 at the bottom dead point becomes shorter than the setting time Ts.

When the staying time becomes shorter than the setting time Ts (i.e., when the remaining amount of the toner 35 reaches the reference amount), the control unit 60 stops the motor 63 to stop the rotations of the agitating member 41 and the replenishing member 43. In other words, the control unit 60 stops replenishing of the toner 35 to the toner hopper 37.

Figure 13:
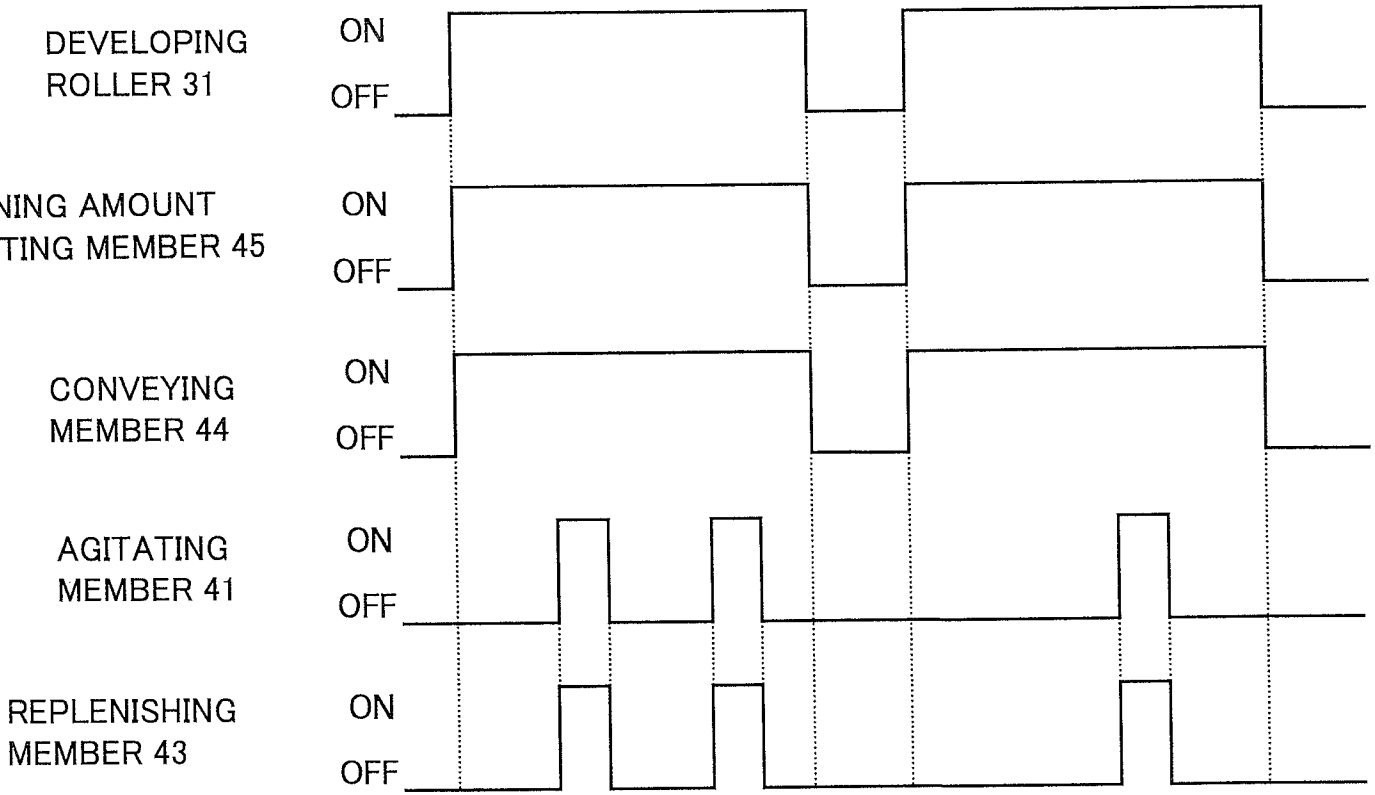
FIG. 13 is a timing chart showing the toner replenishing operation according to the first embodiment of the present invention.

FIG. 13 is a timing chart showing the toner replenishing operation. As shown in FIG. 13, the control unit 60 causes the developing roller 31, the remaining amount detecting member 45 and the conveying member 44 to rotate in synchronization with each other. The control unit 60 starts the rotations of the developing roller 31, the remaining amount detecting member 45 and the conveying member 44 when the control unit 60 starts the image forming operation on each medium 16. The control unit 60 stops the rotations of the developing roller 31, the remaining amount detecting member 45 and the conveying member 44 when the control unit 60 stops the image forming operation on each medium 16.

Further, the control unit 60 causes the replenishing member 43 and the agitating member 41 to rotate in synchronization with each other based on the detection result of the remaining amount of the toner 35. That is, the control unit 60 starts rotations of the replenishing member 43 and the agitating member 41 when the remaining amount of the toner 35 is smaller than the reference amount. The control unit 60 stops rotations of the replenishing member 43 and the agitating member 41 when the remaining amount of the toner 35 reaches the reference amount.

As shown in FIG. 10, the developing roller 31, the remaining amount detecting member 45 and the conveying member 44 which are driven in synchronization with each other (i.e., a group S1) can be driven by a common driving source (in this example, the motor 62). The replenishing member 43 and the agitating member 41 which are driven in synchronization with each other (i.e., a group S2) can be driven by another common driving source (in this example, the motor 63).

As described above, according to the first embodiment of the present invention, the toner 35 is replenished from the toner reserving container 30 to the toner hopper 37 only when the remaining amount of the toner 35 in the toner hopper 37 is smaller than the reference amount. Therefore, the toner 35 is prevented from remaining in the toner hopper 37 for a long time period, i.e., prevented from being agitated by the agitating members 46 and 47 for a long time period. Accordingly, deterioration of the toner can be prevented. As a result, degradation of image quality due to the deterioration of the toner can be prevented, and excellent image quality can be maintained for a long time period.

Further, the toner 35 replenished to the toner hopper 37 via the replenishing opening 42 is conveyed by the conveying member 44 in the longitudinal direction of the toner hopper 37 and is agitated by the remaining amount detecting member 45 so that the toner 35 is uniformly distributed. Therefore, the toner 35 can be uniformly distributed in the longitudinal direction of the toner hopper 37 (i.e., the longitudinal direction of the remaining amount detecting member 45).

Furthermore, the toner 35 is uniformly fed from the ejection openings 501, 502 and 503 of the guide member 50 into the detection region around the remaining amount detecting member (i.e., the region on the regulating member 51). Therefore, the toner 35 is uniformly distributed in the longitudinal direction of the toner hopper 37 (i.e., in the longitudinal direction of the remaining amount detecting member 45), with the result that the remaining amount of the toner 35 can be accurately detected.

Moreover, the remaining amount detecting member 45 is separated from the agitating members 46 and 47 by the regulating member 51, and therefore the remaining amount of the toner 35 can be accurately detected while suppressing influence of agitating motions of the agitating members 46 and 47.

In addition, the toner 35 in the detection region around the remaining amount detecting member 45 is held on the regulating member 51 until the toner 35 around the agitating members 46 and 47 is consumed, and therefore the toner 35 is prevented from being agitated by the agitating members 46 and 47 for a long time period. Accordingly, deterioration of the toner 35 is more surely prevented.

Second Embodiment

Figure 14:
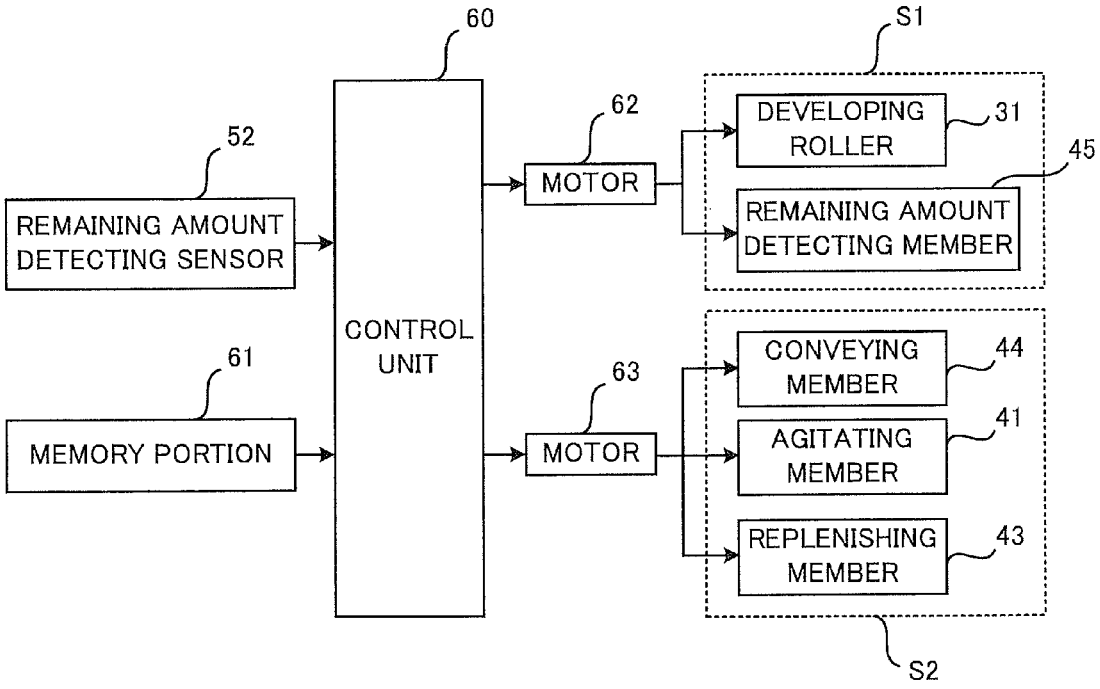
FIG. 14 is a block diagram showing a control system for controlling a toner replenishing operation according to the second embodiment of the present invention.
Figure 15:
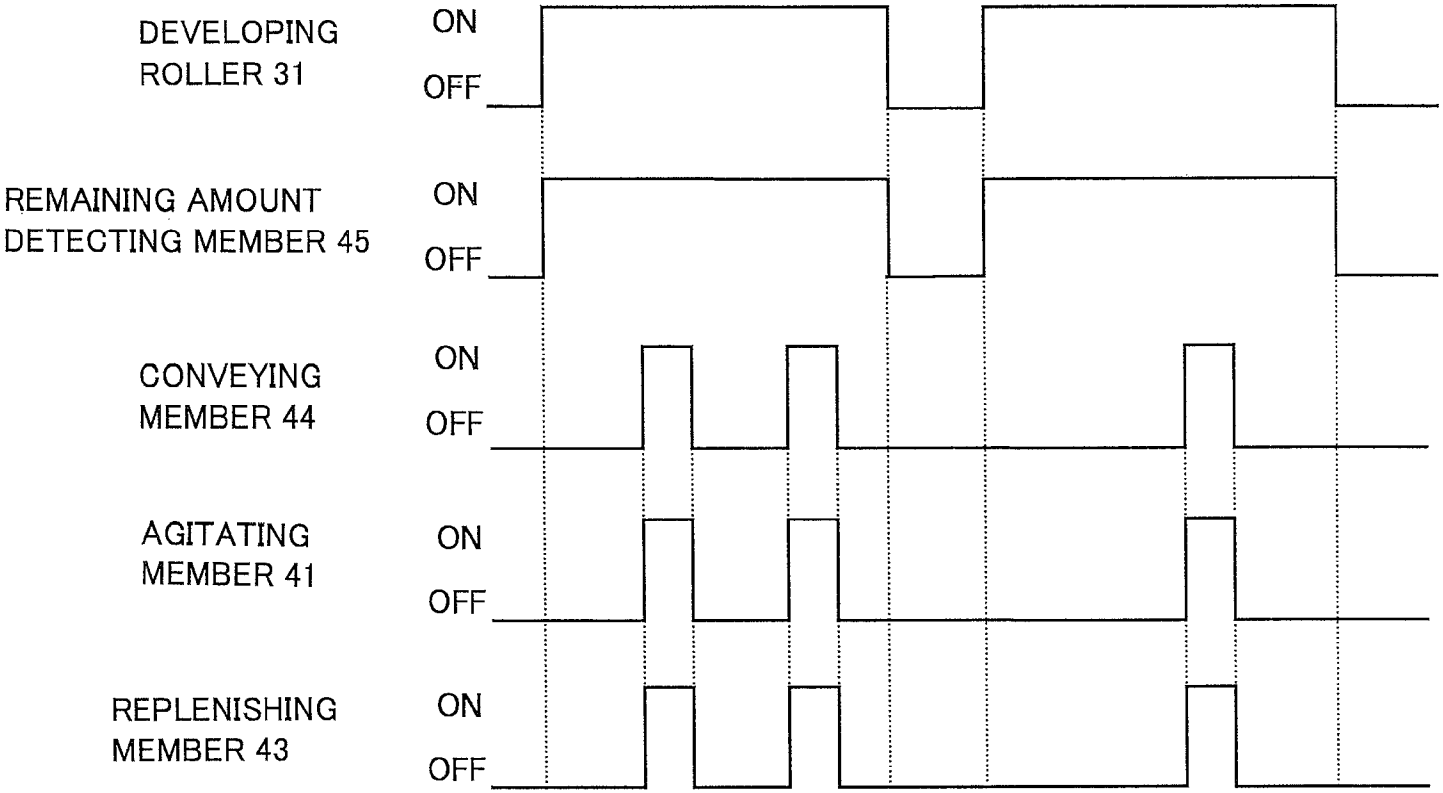
FIG. 15 is a timing chart showing the toner replenishing operation according to the second embodiment of the present invention.

The second embodiment of the present invention will be described. The second embodiment is different from the first embodiment in a controlling system for a toner replenishing operation and timing of the toner replenishing operation. FIG. 14 is a block diagram showing the control system for the toner replenishing operation according to the second embodiment. FIG. 15 is a timing chart of the toner replenishing operation according to the second embodiment.

In the second embodiment, as shown in FIG. 14, the developing roller 31 and the remaining amount detecting member 45 are driven in synchronization with each other and constitute a group S1. The agitating member 41, the replenishing member 43 and the conveying member 44 are driven in synchronization with each other and constitute a group S2.

As shown in FIG. 15, the control unit 60 starts rotations of the developing roller 31 and the remaining amount detecting member 45 at the same time as starting of the image forming operation on each medium 16. The control unit 60 stops the rotations of the developing roller 31 and the remaining amount detecting member 45 at the same time as stopping the image forming operation on each medium 16.

Further, the control unit 60 causes the agitating member 41, the replenishing member 43 and the conveying member 44 to rotate in synchronization with each other based on the detection result of the remaining amount of the toner 35 described in the first embodiment. More specifically, the control unit 60 starts rotating the agitating member 41, the replenishing member 43 and the conveying member 44 when the remaining amount of the toner 35 is smaller than the reference amount. The control unit 60 stops the rotation of the agitating member 41, the replenishing member 43 and the conveying member 44 when the remaining amount of the toner 35 reaches the reference amount.

The developing roller 31 and the remaining amount detecting member 45 (i.e., the group S1) which are driven in synchronization with each other can be driven by a common driving source (in this example, the motor 62). The agitating member 41, the replenishing member 43 and the conveying member 44 (i.e., the group S2) which are driven in synchronization with each other can be driven by another common driving source (in this example, the motor 63).

In the above described first embodiment, the replenishing member 43 and the conveying member 44 are driven in synchronization with each other. That is, the conveying member 44 continues to rotate after the replenishing member 43 stops rotating. Therefore, after the replenishing member 43 stops rotating, almost all of the toner 35 existing in the conveying region is fed out of the conveying region via the ejection openings 501, 502 and 503. When the replenishing member 43 restarts rotating to thereby replenish the toner 35 to the conveying region, the newly replenished toner 35 is first conveyed by the conveying member 44 from the center portion to both end portions of the guide member 50, and then is fed toward the remaining amount detecting member 45 via the ejection openings 502 and 503. Accordingly, it takes time for the toner to reach the detection region around the remaining amount detecting member 45.

In contrast, according to the second embodiment, the replenishing member 43 and the conveying member 44 are driven in synchronization with each other, and therefore the conveying member 44 stops rotating when the replenishing member 43 stops rotating. That is, even after the replenishing member 43 stops rotating, the toner 35 remains in the conveying region inside the guide member 50. When the replenishing member 43 restarts rotating to thereby replenish the toner 35 to the conveying region, the toner 35 is immediately fed toward the remaining amount detecting member 45 via the ejection openings 502 and 503. Accordingly, the time for the toner 35 to reach the detection region around the remaining amount detecting member 45 can be shortened.

As described above, according to the second embodiment, the following advantage is obtained in addition to the advantages described in the first embodiment. That is, if the conveying member 44 and/or the remaining amount detecting member 45 are small in size or if the toner 35 has high viscosity (due to surrounding environment or manufacturing variations or the like), there may be cases where it takes relatively long time to uniformly distribute the toner 35 by agitation. According to the second embodiment, the remaining amount detecting member 45 starts agitating the toner 35 at earlier timing, and therefore the time required for the toner 35 to be uniformly accumulated can be shortened. This is advantageous in maintaining high image quality.

Modification

In the above described first and second embodiments, the replenishing opening 42 and the replenishing member 43 are located at higher positions than the developing roller 31. However, for example, the replenishing opening 42 and the replenishing member 43 can be located at a substantially horizontal position relative to the developing roller 31 as shown in FIG. 16.

Figure 16:
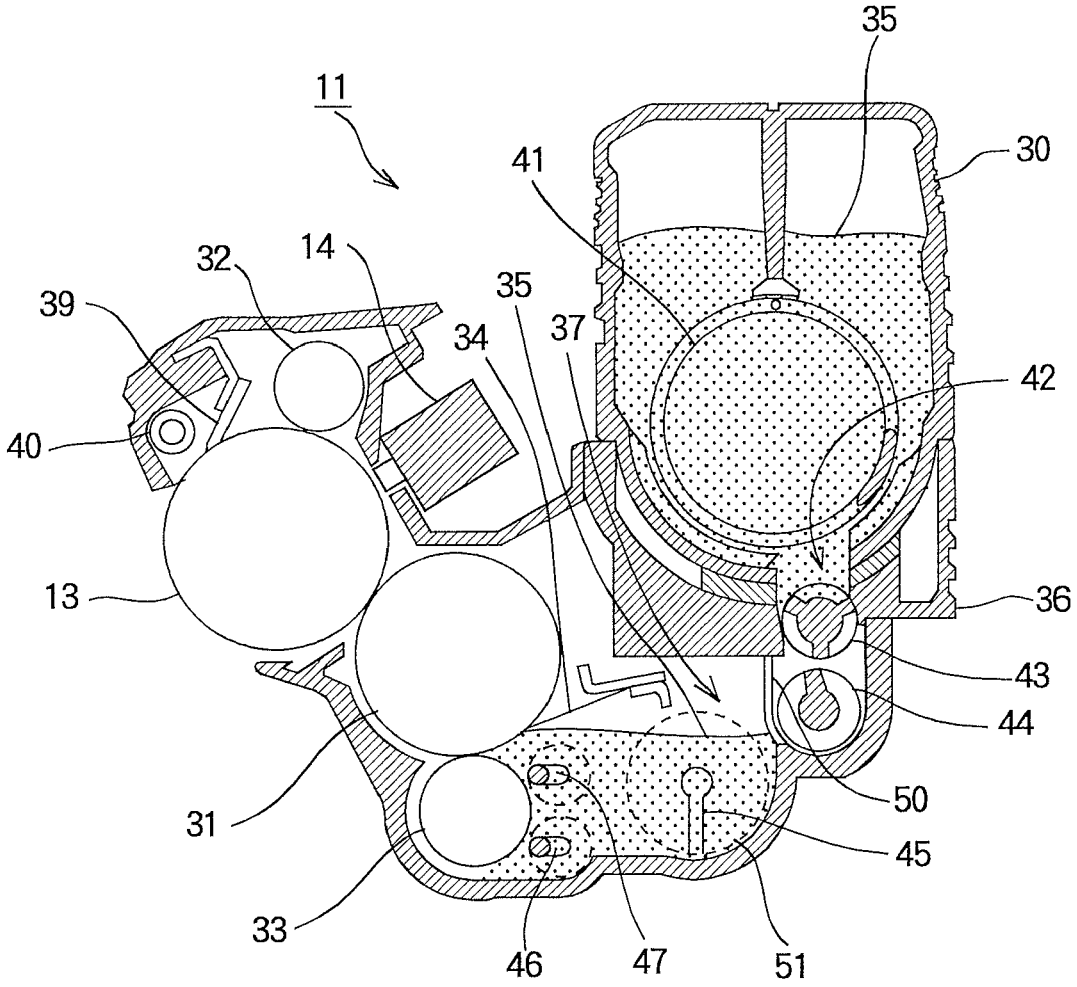
FIG. 16 is a sectional view showing another configuration example of the image forming unit according to the first and second embodiments of the present invention.

In a configuration shown in FIG. 16, the toner 35 replenished to the toner hopper 37 via the replenishing opening 42 is conveyed by the conveying member 44 inside the guide member 50, and reaches the detection region around the remaining amount detecting member 45. The detection of the remaining amount of the toner 35 is performed as described in the first embodiment.

In the toner hopper 37, the toner 35 is agitated by the agitating members 46 and 47, is supplied to the developing roller 31 by the supplying roller 33, and is used for development of the latent image on the photosensitive drum 13. In this regard, it is also possible to further provide the regulating member 51 (see FIG. 2) that separates the remaining amount detecting member 45 from the agitating members 46 and 47.

Third Embodiment

Figure 17:
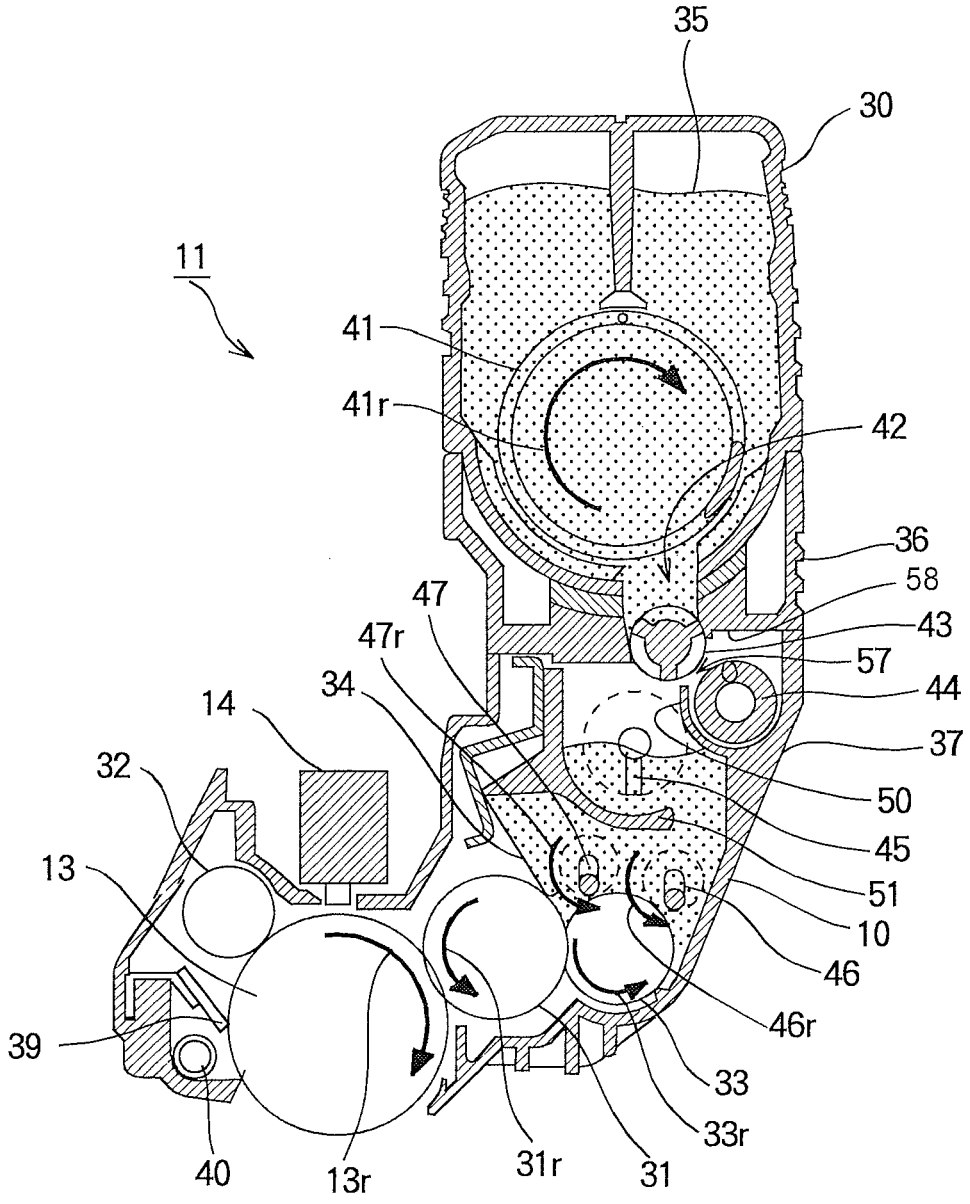
FIG. 17 is a sectional side view showing a configuration of an image forming unit according to the third embodiment of the present invention.
Figure 18:
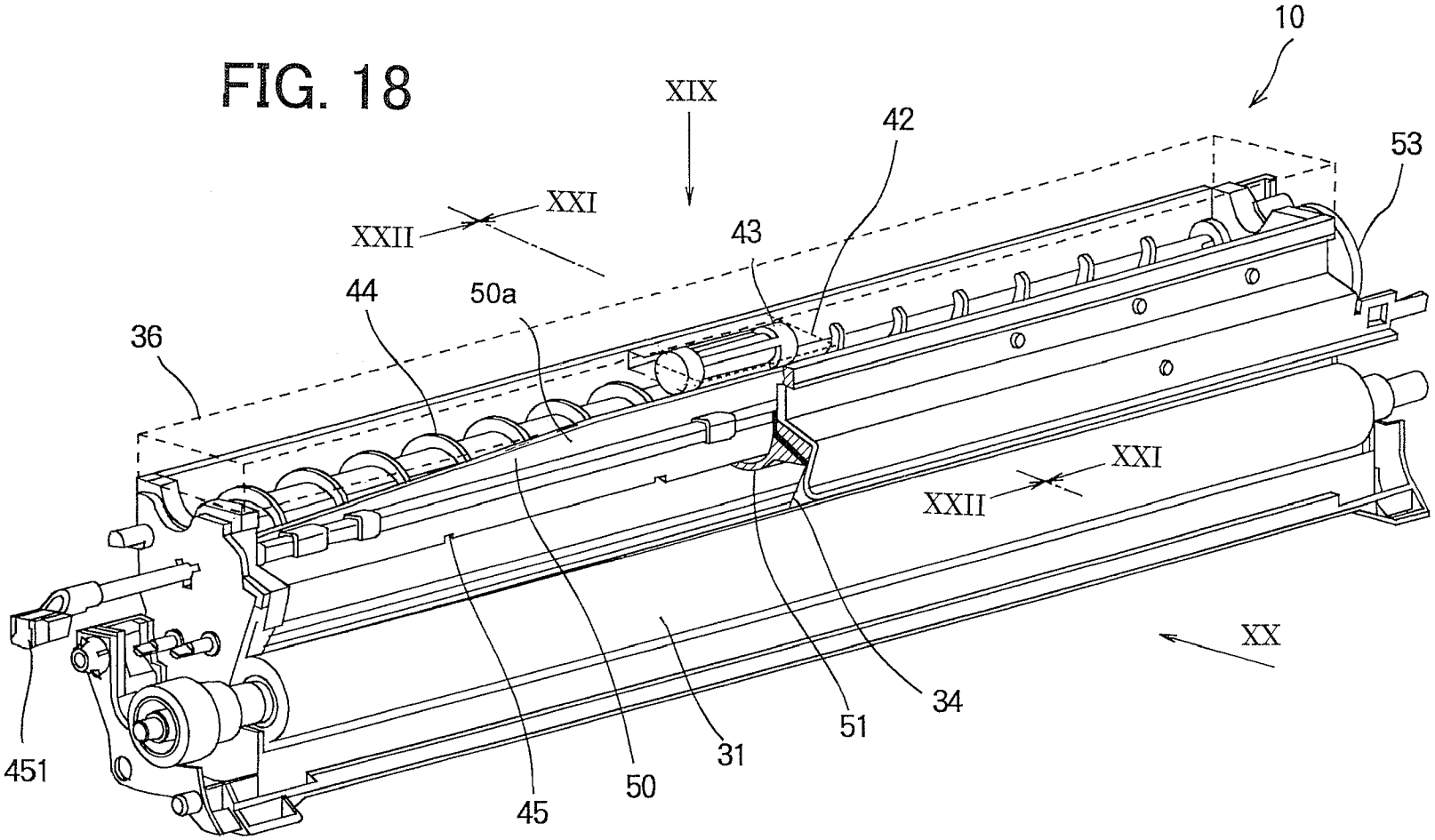
FIG. 18 is a perspective view showing a configuration of a main body of the image forming unit according to the third embodiment of the present invention.
Figure 19:
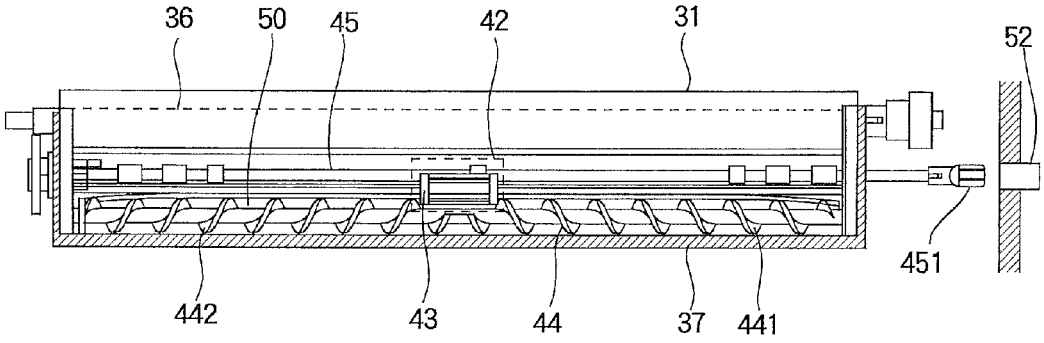
FIG. 19 is a sectional view showing the main body of the image forming unit as seen in a direction shown by an arrow XIX in FIG. 18.
Figure 20:
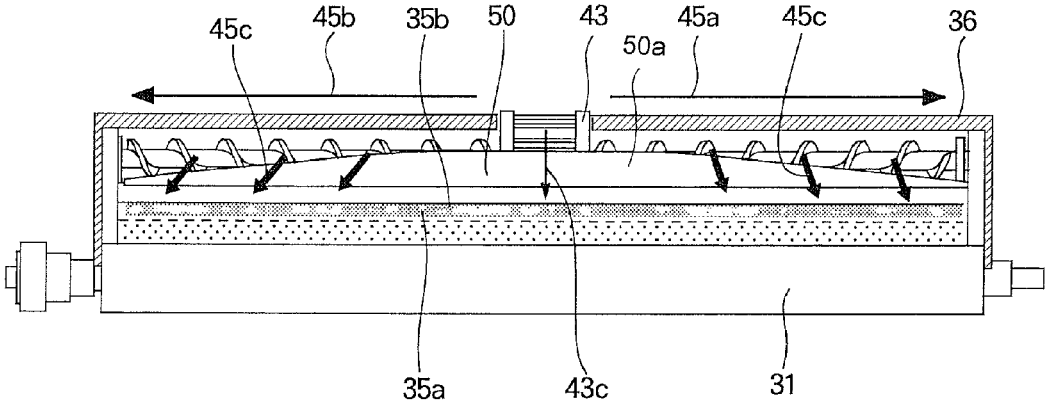
FIG. 20 is a sectional view showing the main body of the image forming unit as seen in a direction shown by an arrow XX in FIG. 18.

The third embodiment of the present invention will be described. FIG. 17 is a sectional side view showing a configuration of an image forming unit 11 according to the third embodiment. FIG. 18 is partially cutaway perspective view showing a configuration of an image forming unit main body 10 according to the third embodiment. FIGS. 19 and 20 are views showing the configuration of the image forming unit main body 10 of the third embodiment as respectively seen in directions shown by arrows XIX and XX in FIG. 18.

In the above described first embodiment, the guide member 50 has a constant height and has ejection openings 501, 502 and 503 at the center portion and both end portions (see FIG. 7). In contrast, a guide member 50 of the third embodiment has a wall surface portion 50*a* that temporarily holds the toner 35 replenished by the replenishing member 43, and regulates falling of the toner 35 (toward the remaining amount detecting member 45) in the axial direction of the developing roller 31.

To be more specific, the wall surface portion 50*a* is so shaped that heights at both end portions in the longitudinal direction of the guide member 50 (i.e., in the axial direction of the developing roller 31) are lower than the height at the center portion in the same direction. More specifically, the height of the guide member 50 is the highest at the center portion and gradually decreases toward both end portions. That is, the wall surface portion 50*a* has inclined portions which are inclined from the center portion to both end portions.

In other words, the guide member 50 of the third embodiment is configured to allow the toner 35 to climb over portions of the guide member 50 with low heights. In this regard, the guide member 50 of the third embodiment does not have the ejection openings 501, 502 and 503 (see FIG. 7) described in the first embodiment.

In the above described first embodiment, the conveying member 44 has the protruding portions 444 and 445 at both ends in the longitudinal direction (see FIG. 5). In contrast, in the third embodiment, the spiral portions 441 and 442 of the conveying member 44 respectively extend toward both ends.

In the above described first embodiment, almost all of the toner 35 replenished by the replenishing member 43 falls into the conveying region inside the conveying member 44 (see FIG. 2). In contrast, in the third embodiment, a part of the toner 35 replenished by the replenishing member 43 falls into the conveying region inside the guide member 50, and another part of the toner 35 replenished by the replenishing member 43 falls into the detection region around the remaining amount detecting member 45.

For this purpose, the guide member 50 is located vertically below the replenishing opening 43. The conveying member 44 is located at a position laterally shifted from a position vertically below the replenishing opening 43. An opening 57 is formed by the guide member 50 and an upper surface 58 of the toner hopper 37. The opening 57 opens toward the replenishing member 43.

As described above, the guide member 50 of the third embodiment has the wall surface portion 50*a* whose height decreases from the center portion toward both end portions in the longitudinal direction of the guide member 50. Among the toner 35 replenished by the replenishing member 43, a part of the toner 35 falls into the conveying region inside the guide member 50 and is conveyed by the conveying member 44 to both ends in the longitudinal direction. Such toner 35 climbs over the portions of the guide member 50 with low heights, and falls into the detection region around the remaining amount detecting member 45 (i.e., the region on the regulating member 51).

Further, among the toner 35 replenished by the replenishing member 43, another part of the toner 35 does not fall into the conveying region inside the guide member 50, but falls into a center portion of the detection region around the remaining amount detecting member 45. Angles of the inclined portions of the guide member 50 are so determined that the toner 35 accumulated in the detection region around the remaining amount detecting member 45 (i.e., on the regulating member 51) is uniformly distributed in the longitudinal direction of the remaining amount detecting member 45.

Figure 21A:
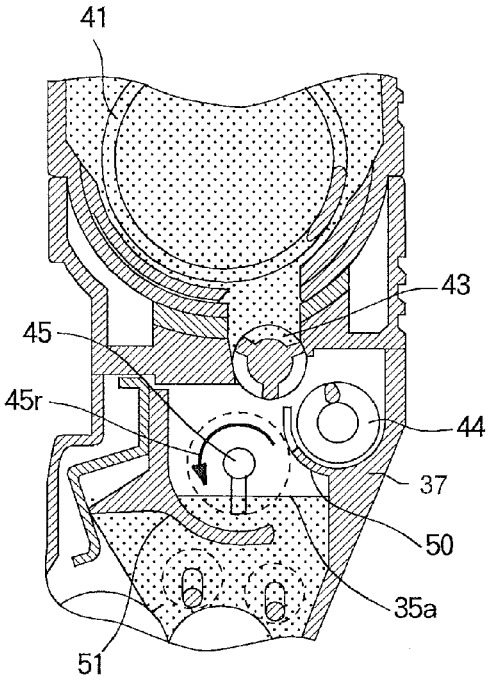
FIG. 21A is a schematic sectional view showing functions of a replenishing member, a conveying member and a remaining amount detecting member according to the third embodiment when a remaining amount of a toner in a toner hopper is small.
Figure 21B:
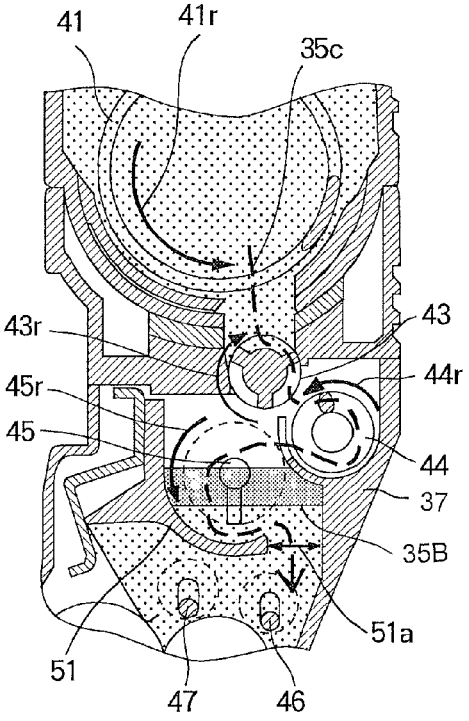
FIG. 21B is a schematic sectional view showing functions of the replenishing member, the conveying member and the remaining amount detecting member according to the third embodiment when the remaining amount of the toner in the toner hopper is large.

FIG. 21A is a schematic sectional view showing functions of the replenishing member 43, the conveying member 44 and the remaining amount detecting member 45 when the remaining amount of the toner 35 in the toner hopper 37 is small. FIG. 21B is a schematic sectional view showing functions of the replenishing member 43, the conveying member 44 and the remaining amount detecting member 45 when the remaining amount of the toner 35 in the toner hopper 37 is large. FIGS. 21A and 21B correspond to a sectional view as seen in a direction shown by an arrow XXI in FIG. 18.

Figure 22A:
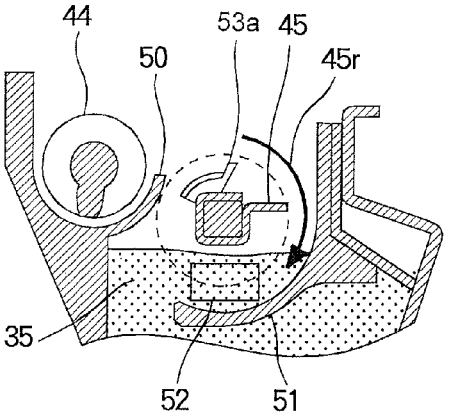
FIG. 22A is a schematic sectional view showing functions of the conveying member and the remaining amount detecting member according to the third embodiment when the remaining amount of the toner in the toner hopper is small.
Figure 22B:
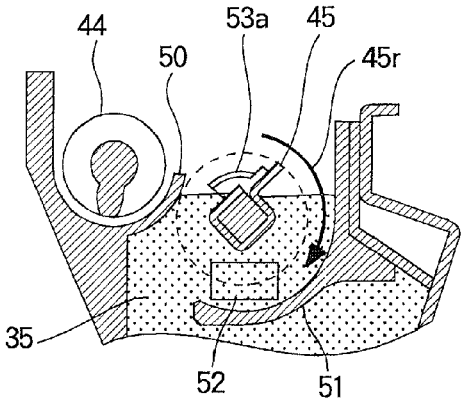
FIG. 22B is a schematic sectional view showing functions of the conveying member and the remaining amount detecting member according to the third embodiment when the remaining amount of the toner in the toner hopper is large.

FIG. 22A is a schematic sectional view showing functions of the conveying member 44 and the remaining amount detecting member 45 when the remaining amount of the toner 35 in the toner hopper is small. FIG. 220 is a schematic sectional view showing functions of the conveying member 44 and the remaining amount detecting member when the remaining amount of the toner 35 in the toner hopper 37 is large. FIGS. 22A and 22B correspond to a sectional view as seen in a direction shown by an arrow XXII in FIG. 18.

The remaining amount of the toner 35 is detected using the remaining amount detecting member 45 in a similar manner as described in the first embodiment. As shown in FIGS. 21A and 22A, when the remaining amount of the toner 35 is smaller than the reference amount (i.e., when the staying time of the remaining amount detecting member 45 at the bottom dead point is longer than the setting time Ts), the control unit 60 drives the motor 63 (FIG. 10) to rotate the agitating member 41 and the replenishing member 43.

Among the toner 35 replenished into the toner hopper 37 by the replenishing member 43, a part of the toner 35 falls into the conveying region inside the guide member 50 as shown in FIGS. 21B and 22B. In the conveying region, the conveying member 44 rotates in a direction shown by an arrow 44*r*, and the spiral portions 441 and 442 of the conveying member 44 convey the toner toward both ends in the axial direction. The toner 35 reaching both ends of the conveying member 44 climbs over the portions of the guide member 50 with low heights, and falls into the detection region around the remaining amount detecting member 45. A flow of the toner 35 is shown by an arrow 35C in FIG. 21B.

Further, among the toner 35 replenished into the toner hopper 37 by the replenishing member 43, another part of the toner 35 does not fall into the conveying region inside the guide member 50, but falls into the detection region around the remaining amount detecting member 45 (i.e., the region on the regulating member 51) at the center portion in the longitudinal direction.

Accordingly, the toner 35 is accumulated in the detection region around the remaining amount detecting member 45, and is uniformly distributed in the longitudinal direction of the remaining amount detecting member 45. Further, since the remaining amount detecting member 45 agitates the toner 35 in the detection region, the toner 35 is further uniformly distributed.

When the amount of the toner 35 exceeds the predetermined amount (i.e., the reference amount), the control unit 60 stops the rotations of the agitating member 41, the replenishing member 43 and the conveying member 44 to thereby stop replenishing of the toner 35 to the toner hopper 37.

In the third embodiment of the present invention, the toner 35 is replenished from the toner reserving container 30 to the toner hopper 37 when the remaining amount of the toner 35 in the toner hopper 37 is smaller than the reference amount as in the first embodiment. Therefore, the toner 35 is prevented from remaining in the toner hopper 37 for a long time period, i.e., prevented from being agitated by the agitating members 46 and 47 for a long time period. Accordingly, deterioration of the toner can be prevented. As a result, degradation of image quality due to the deterioration of the toner can be prevented, and excellent image quality can be maintained for a long time period.

Further, in the third embodiment, the guide member 50 has the wall surface portion 50*a* having a shape in which the height decreases from the center portion toward both end portions in the longitudinal direction of the guide member 50. Therefore, a part of the toner 35 falls from the replenishing member 43 into the detection region around the remaining amount detecting member 45, and another part of the toner 35 is conveyed by the conveying member 44 and climbs over the portions of the guide member 50 with low heights. Accordingly, the toner 35 is uniformly distributed in the longitudinal direction of the toner hopper 37 (i.e., in the longitudinal direction of the remaining amount detecting member 45). As a result, the remaining amount of the toner 35 can be accurately detected.

Moreover, the remaining amount detecting member 45 is separated from the agitating members 46 and 47 by the regulating member 51 as in the first embodiment, and therefore the remaining amount of the toner 35 can be accurately detected while suppressing influence of agitating motions of the agitating members 46 and 47. Further, the toner 35 in the detection region around the remaining amount detecting member 45 is held on the regulating member 51 until the toner 35 around the agitating members 46 and 47 is consumed, and therefore the toner 35 is prevented from being agitated by the agitating members 46 and 47 for a long time period. Accordingly, deterioration of the toner 35 is more surely prevented.

Fourth Embodiment

The fourth embodiment of the present invention will be described. The fourth embodiment is different from the third embodiment in shape of a conveying member 54.

Figure 23:
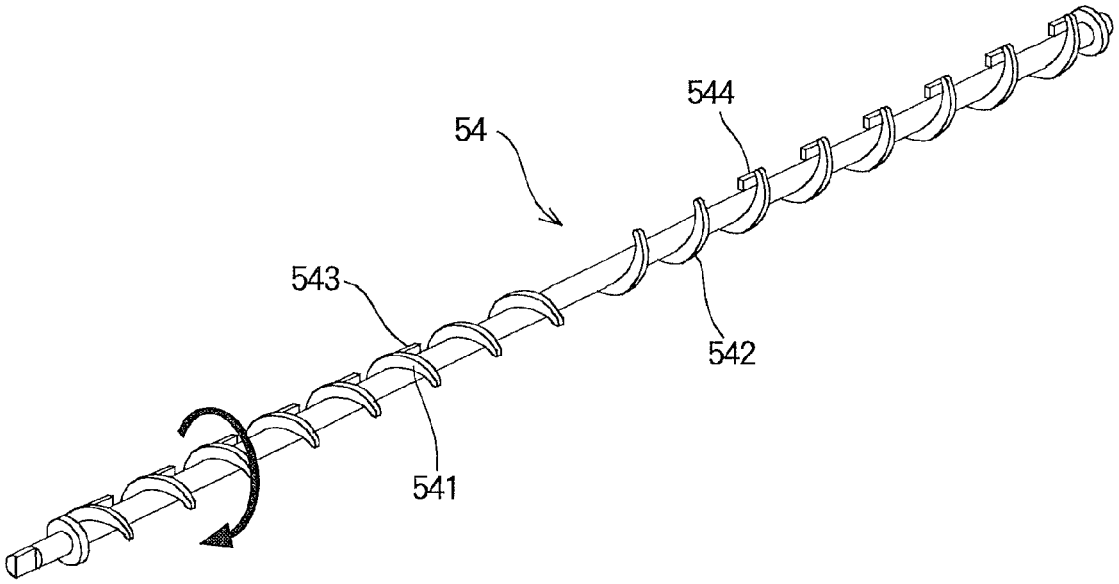
FIG. 23 is a perspective view showing a conveying member according to the fourth embodiment of the present invention.

FIG. 23 is a perspective view showing the shape of the conveying member 54 according to the fourth embodiment. The conveying member 44 (FIG. 19) of the above described third embodiment has the spiral portions 441 and 442 extending from the center portion to the end portions in the axial direction. In contrast, as shown in FIG. 23, the conveying member 54 of the fourth embodiment has a plurality of protruding portions 543 and a plurality of protruding portions 544 in addition to the spiral portions 541 and 542. The protruding portions 543 and 544 extend in the axial direction of the conveying member 54.

The protruding portions 543 and 544 are not provided on a center portion of the conveying member 54 in the axial direction, but are provided in regions within predetermined ranges from both ends of the conveying member 54. The protruding portion 543 is formed continuously with the spiral portion 541. The protruding portion 544 is formed continuously with the spiral portion 542.

The guide member 50 has the wall surface portion 50*a* (see FIG. 20) whose height decreases from the center portion toward both end portions in the longitudinal direction of the guide member 50. The toner 35 conveyed by the conveying member 54 climbs over the guide member 50 and falls into the detection region around the remaining amount detecting member 45 (i.e., the region on the regulating member 51). Since the conveying member 54 has protruding portions 543 and 544 extending in the axial direction, a force in the rotating direction of the conveying member 54 is effectively applied to the toner 35 by the protruding portions 543 and 544 when the conveying member 54 rotates. Therefore, it becomes easier for the toner 35 to climbs over the guide member 50.

The conveying member 54 of the fourth embodiment is advantageous particularly when the toner 35 has low fluidity. That is, when the toner 35 has low fluidity, mobility of the toner 35 in a radial direction of the conveying member 54 decreases, and therefore the toner 35 tends not to be uniformly distributed. However, according to the fourth embodiment, the conveying member 54 applies a force in the rotating direction to the toner 35 via the protruding portions 543 and 544, and therefore the toner 35 easily climbs over the guide member 50. Accordingly, the toner 35 can be uniformly accumulated even when the toner 35 has low fluidity.

The above described embodiments can be appropriately modified. For example, the modification (FIG. 16) of the first and second embodiments is also applicable to the third and fourth embodiments.

In the above described embodiments, the image forming units of the color printer (as the image forming apparatus) have been described. However, the present invention is also applicable to a copier, an LED printer, a laser beam printer, a facsimile machine, a multifunction peripheral or the like.

While the preferred embodiments of the present invention have been illustrated in detail, it should be apparent that modifications and improvements may be made to the invention without departing from the spirit and scope of the invention as described in the following claims.

What is claimed is:

1. An image forming unit, comprising:

an image bearing body;

a developer bearing body that supplies a developer to the image bearing body;

a developer storage portion for storing the developer to be supplied to the developer bearing body;

a developer reserving portion that reserves the developer to be supplied to the developer storage portion;

a replenishing member that replenishes the developer from the developer reserving portion to the developer storage portion;

a guide member provided between the replenishing member and the developer bearing body, the guide member being configured to temporarily hold the developer replenished by the replenishing member and regulate falling of the developer;

a conveying member that conveys the developer held by the guide member in an axial direction of the developer bearing body along the guide member;

a detecting portion provided between the guide member and the developer bearing body, the detecting portion being provided for detecting the developer;

an agitating member that agitates the developer in the developer storage portion; and a regulating member provided so as to separate the agitating member from the detecting portion, wherein the replenishing member replenishes the developer to the developer storage portion based on a result of detection using the detecting portion, wherein the guide member has a wall surface portion, and wherein the wall surface portion is so shaped that heights at both end portions in the axial direction of the developer bearing body is lower than a height at a substantially center portion in the axial direction of the developer bearing body.

2. The image forming unit according to claim 1, wherein the replenishing member replenishes the developer to the developer storage portion when a remaining amount of the developer detected using the detecting portion is smaller than a predetermined amount.

3. The image forming unit according to claim 1, wherein the replenishing member is provided above the developer bearing body.

4. The image forming unit according to claim 1, wherein the guide member has inclined portions which are inclined from the substantially center portion to both end portions.

5. The image forming unit according to claim 1, wherein the replenishing member is located at a position corresponding to a substantially center portion in the axial direction of the developer bearing body, wherein the conveying member conveys the developer from the position corresponding to the substantially center portion in the axial direction of the developer bearing body to positions corresponding to both end portions in the axial direction of the developer bearing body.

6. The image forming unit according to claim 1, wherein the regulating member temporarily holds the developer in the vicinity of the detecting portion.

7. The image forming unit according to claim 1, wherein the regulating member is located between the developer bearing body and the detecting portion.

8. The image forming unit according to claim 1, wherein the developer bearing body is not provided vertically below a gap portion between a wall portion surrounding the developer storage portion and the regulating member.

9. The image forming unit according to claim 1, wherein the guide member includes a plurality of ejection openings.

10. The image forming unit according to claim 9, wherein a replenishing opening is provided between the developer reserving portion and the developer storage portion, and wherein the replenishing opening and at least one of the plurality of ejection openings are located at a position corresponding to a center portion in the axial direction of the developer bearing body.

11. The image forming unit according to claim 9, wherein at least one of the plurality of ejection openings is located at a position corresponding to a center portion in the axial direction of the developer bearing body, and wherein at least two of the plurality of ejection openings are located at positions corresponding to both end portions in the axial direction of the developer bearing body.

12. The image forming unit according to claim 1, further comprising a control unit that drives the conveying member in synchronization with the developer bearing body.

13. The image forming unit according to claim 1, further comprising a control unit that drives the conveying member in synchronization with the replenishing member.

14. An image forming apparatus comprising the image forming unit according to claim 1.

15. An image forming unit, comprising:

an image bearing body;

a developer bearing body that supplies a developer to the image bearing body;

a developer storage portion for storing the developer to be supplied to the developer bearing body;

a developer reserving portion that reserves the developer to be supplied to the developer storage portion;

a replenishing member that replenishes the developer from the developer reserving portion to the developer storage portion;

a guide member provided between the replenishing member and the developer bearing body, the guide member being configured to temporarily hold the developer replenished by the replenishing member and regulate falling of the developer;

a conveying member that conveys the developer held by the guide member in an axial direction of the developer bearing body along the guide member;

a detecting portion provided between the guide member and the developer bearing body, the detecting portion being provided for detecting the developer;

an agitating member that agitates the developer in the developer storage portion; and a regulating member provided so as to separate the agitating member from the detecting portion, wherein the replenishing member replenishes the developer to the developer storage portion based on a result of detection using the detecting portion, wherein the detecting portion is rotatable, and wherein the regulating member is provided along a rotating direction of the detecting portion.

16. An image forming unit comprising:

an image bearing body on which a latent image is formed;

a developer bearing body that develops the latent image on the image bearing body using a developer;

a developer storage portion that stores the developer to be supplied to the developer bearing body;

a developer reserving portion provided above the developer storage portion;

a replenishing opening for replenishing the developer from the developer reserving portion to the developer storage portion;

a replenishing member that replenishes the developer from the replenishing opening to the developer storage portion;

a conveying member provided in the developer storage portion and located below the replenishing member, the conveying member conveying the developer in an axial direction of the developer bearing body;

a guide member provided in the developer storage portion and located below the replenishing member, the guide member guiding the developer conveyed by the conveying member in the axial direction of the developer bearing body; and a remaining amount detecting portion provided in the developer storage portion and located between the conveying member and the developer bearing body, the remaining amount detecting portion detecting a remaining amount of the developer, wherein the guide member has a shape such that a height decreases from a center portion toward both end portions, and wherein the conveying member includes a spiral portion that conveys the developer toward both end portions, and a protruding portion that conveys the developer in a rotating direction of the conveying member, wherein the protruding portion is provided between a plurality of parts of the spiral portion.

17. The image forming unit according to claim 16, wherein the conveying member includes a first region where the protruding portion is provided between the plurality of parts of the spiral portion, and a second region where no protruding portion is provided.

18. The image forming unit according to claim 17, wherein the first region and the second region are provided in a section between adjacent two parts of the spiral portion.

19. The image forming unit according to claim 16, wherein the protruding portions extend from both end portion sides of the conveying member toward the center portion of the conveying member.

20. The image forming unit according to claim 16, wherein the protruding portions are provided in predetermined regions from both end portions of the conveying member, and wherein no protruding portion is provided in the center portion of the conveying member.

21. The image forming unit according to claim 16, further comprising an agitating member provided below the remaining amount detecting portion, the agitating member agitating the developer in the developer storage portion.

22. The image forming unit according to claim 16, wherein the protruding portion is provided between parts of the spiral portion so as not to face the replenishing opening.

23. An image forming apparatus comprising the image forming unit according to claim 16.

24. The image forming unit according to claim 16, wherein the conveying member includes a shaft portion, and wherein the protruding portion extends from the spiral portion in a direction in which the conveying member conveys the developer, and also extends outwardly from the shaft portion.

25. The image forming unit according to claim 16, wherein the replenishing opening is located at a position corresponding to a substantially center portion in the axial direction of the developer bearing body.

* * * * *